US007226043B2

(12) United States Patent
Stone et al.

(10) Patent No.: US 7,226,043 B2
(45) Date of Patent: Jun. 5, 2007

(54) STABLE FAIL-SAFE CLEAT WITH AUTOMATIC IN-LINE LOCKING CAM

(76) Inventors: Peter Stone, 9000 Shore Rd., Apt. E14G, Brooklyn, NY (US) 11209; Anton P. Vasyukevich, 1015 Arcadia Ave., #17, Arcadia, CA (US) 91007

( * ) Notice: Subject to any disclaimer, the term of this patent is extended or adjusted under 35 U.S.C. 154(b) by 227 days.

(21) Appl. No.: 11/103,315

(22) Filed: Apr. 11, 2005

(65) Prior Publication Data

US 2005/0205852 A1 Sep. 22, 2005

Related U.S. Application Data

(63) Continuation-in-part of application No. 10/952,067, filed on Sep. 28, 2004, which is a continuation-in-part of application No. 10/875,462, filed on Jun. 24, 2004, now Pat. No. 7,073,780, which is a continuation-in-part of application No. 10/834,947, filed on Apr. 30, 2004, which is a continuation-in-part of application No. 09/846,831, filed on May 1, 2001, now Pat. No. 6,742,770, which is a continuation-in-part of application No. 09/414,933, filed on Oct. 9, 1999, now Pat. No. 6,234,454, which is a continuation-in-part of application No. 08/984,023, filed on Dec. 3, 1997, now abandoned.

(51) Int. Cl.
*B66D 3/84* (2006.01)

(52) U.S. Cl. ..... 254/391; 24/134 KA; 24/134 KB

(58) Field of Classification Search ..... 254/391; 24/134 KA, 134 KB; 114/218
See application file for complete search history.

(56) References Cited

U.S. PATENT DOCUMENTS 152,635 A 6/1874 Hewitt
(Continued)

*Primary Examiner*—Emmanuel M Marcelo

(57) ABSTRACT

A failsafe stable cleat with automatic in-line line-locking includes a frame having proximate and a remote sides on substantially opposite sides of the frame and formed with a passageway, extending between the proximate and remote sides, for receiving a line and generally defining a cleat center line along which a line can move along a first line releasing direction from the proximate to the remote sides and a line pulling direction from the remote to the proximate sides; attaching members for attaching the frame to a support surface. A cam on the frame on one side of the passageway has a line engaging portion spaced a predetermined distance from the support surface, the cam being movable between a line releasing position and a line locking position. A pusher on the frame is positioned on an opposite side of the passageway in relation to the cam for selectively applying a force on the line in the direction of the cam A cam biasing member tends to urge the cam to disengage from the line while a pusher biasing member normally tends to move the line across the gap into contact with the cam while permitting the line to return to the passageway out of contact with the cam when sufficient tension is applied by the user off the cleat center line to create a force component to offset the pushing force created by the pusher biasing member. This promotes unlocking of the line and allowing the line to move in the first line releasing direction, engagement of the line by the cam to the line locking position creating a force couple which is a function of the predetermined distance, that tends to separate the frame from the support surface. A stabilizing element compensates for and offsets the force couple independently of the dimensions or configuration of the frame.

20 Claims, 29 Drawing Sheets

U.S. PATENT DOCUMENTS

| | | | |
|---|---|---|---|
| 723,231 | A | 3/1903 | Benedict |
| 826,727 | A | 4/1906 | Koorie |
| 1,107,934 | A | 8/1914 | Hagan |
| 1,167,295 | A | 1/1916 | Hall |
| 1,366,212 | A | 1/1921 | Pollard |
| 1,383,665 | A | 1/1921 | Roban |
| 1,452,338 | A | 4/1923 | Flowers |
| 1,520,716 | A | 3/1924 | Judo |
| 1,735,691 | A | 11/1929 | Morgan |
| 2,200,896 | A | 5/1940 | Rio |
| 2,867,875 | A | 1/1959 | Davison |
| 3,113,545 | A | 12/1963 | Von Opel |
| 3,265,032 | A | 8/1966 | Hume |
| 3,580,209 | A | 5/1971 | Orsou et al. |
| 3,677,214 | A | 7/1972 | Bernstein et al. |
| 3,730,129 | A | 5/1973 | Helms |
| 3,750,611 | A | 8/1973 | Field |
| 3,758,922 | A | 9/1973 | Field |
| 3,765,061 | A | 10/1973 | Nash |
| 3,795,218 | A | 3/1974 | Merry |
| 4,084,532 | A | 4/1978 | Feder |
| 4,092,941 | A | 6/1978 | Gryglas |
| 4,195,587 | A | 4/1980 | Voss et al. |
| 4,278,042 | A | 7/1981 | Lindquist |
| 4,340,997 | A | 7/1982 | Voss |
| 4,348,974 | A | 9/1982 | Lerner |
| 4,397,253 | A | 8/1983 | Uecker et al. |
| 4,453,486 | A | 6/1984 | Harken |
| 4,502,668 | A | 3/1985 | Dodge |
| 4,620,499 | A | 11/1986 | Slemmons |
| 4,660,493 | A | 4/1987 | Lowry, III |
| 4,766,835 | A | 8/1988 | Randall et al. |
| 4,899,423 | A | 2/1990 | Randall |
| 4,934,660 | A | 6/1990 | Nelson |
| 5,067,621 | A | 11/1991 | Alexander |
| 5,070,805 | A | 12/1991 | Plante |
| 5,249,544 | A | 10/1993 | Lacan |
| 5,615,865 | A | 4/1997 | Fountain |
| 5,738,339 | A | 4/1998 | Kuryu |
| 5,816,636 | A | 10/1998 | Gibson et al. |
| 5,845,894 | A | 12/1998 | Petzl et al. |
| 5,931,112 | A | 8/1999 | Lacan |
| 6,068,242 | A | 5/2000 | Kingery |
| 6,092,791 | A | 7/2000 | Kingery |
| 6,182,946 | B1 | 2/2001 | Rutherford |
| 6,223,868 | B1 | 5/2001 | Wullimann |
| 6,505,384 | B1 | 1/2003 | Renton et al. |
| 6,685,171 | B2 | 2/2004 | Lob et al. |
| 6,698,723 | B1 | 3/2004 | Antonini |
| 6,722,303 | B2 | 4/2004 | Lob et al. |
| 6,729,000 | B1 | 5/2004 | Liu |
| 6,857,381 | B2 | 2/2005 | Siewert et al. |

Fig. 44
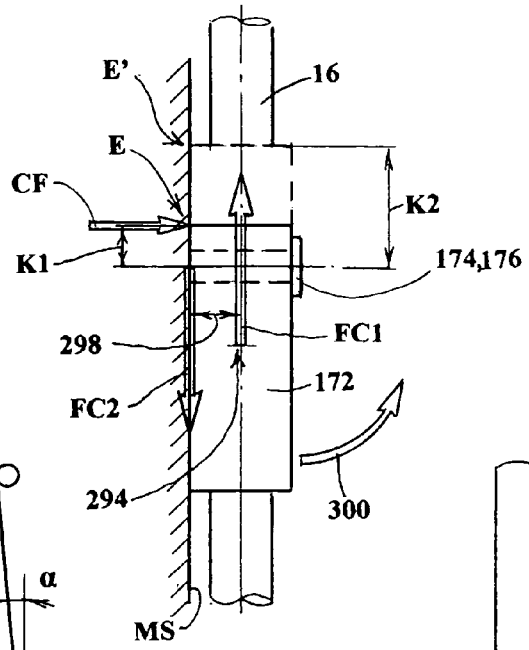
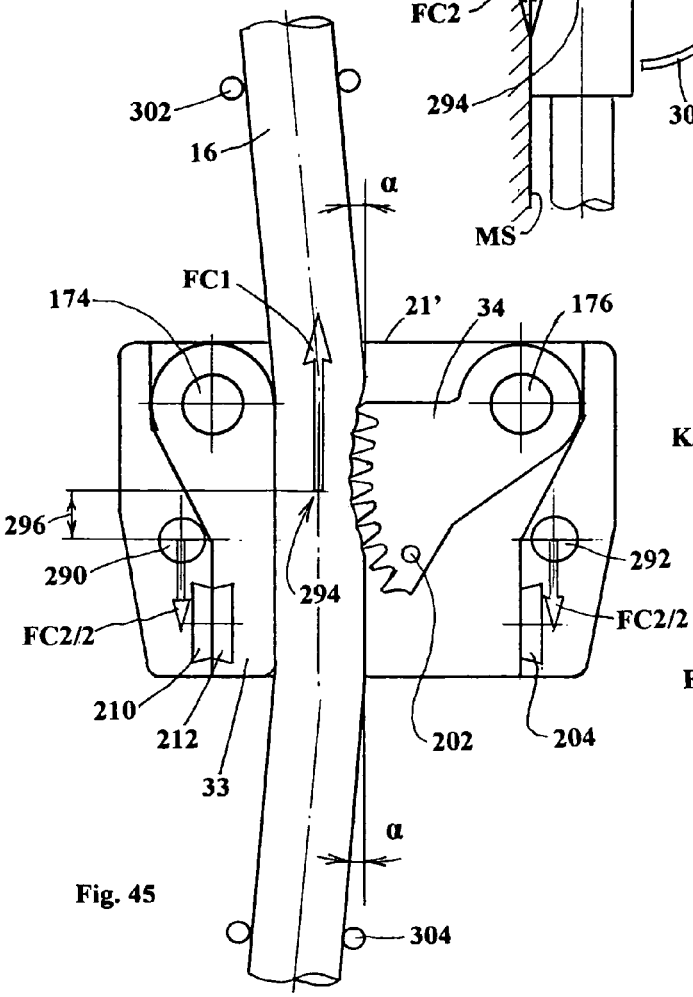
Fig. 45
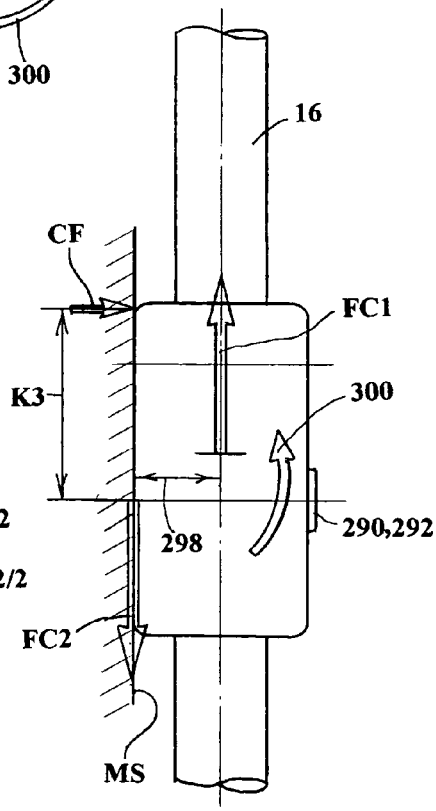
Fig.46

STABLE FAIL-SAFE CLEAT WITH AUTOMATIC IN-LINE LOCKING CAM

CROSS-REFERENCE TO RELATED APPLICATIONS

This is a continuation-in-part of application Ser. No. 10/952,067, filed on Sep. 28, 2004, now pending, which was a continuation-in-part of application Ser. No. 10/875,462, filed on Jun. 24, 2004, now U.S. Pat. No. 7,073,780, which was a continuation-in-part of application Ser. No. 10/834,947, filed on Apr. 30, 2004, now pending, which was a continuation-in-part of application Ser. No. 09/846,831, filed on May 1, 2001, now U.S. Pat. No. 6,742,770 issued on Jun. 1, 2004, which was a continuation-in-part of application Ser. No. 09/414,933, filed on Oct. 9, 1999, issued as U.S. Pat. No. 6,234,454 on May 22, 2001, which was a continuation-in-part of application Ser. No. 08/984,023, filed on Dec. 3, 1997, abandoned.

BACKGROUND OF THE INVENTION

1. Field of the Invention

This invention relates to cleats of the type generally used on sailing craft for holding lines such as a sail sheets, and more particularly it relates to a stable fail-safe cleat with automatic in-line locking cam that stabilizes the cleat mounted on a support surface independently of the dimensions or configuration of the housing or frame of the cleat.

2. Description of the Prior Art

In a conventional cleat, a line or rope is placed between two eccentric pivoted cams along a cleat center-line and relatively little resistance is applied on the line when it moves in one direction along the center-line, while the line becomes jammed between the cams when tension is exerted on the line in a reverse direction. The greater the tension applied on the line in the reverse direction, the greater the force exerted by the cam cleats on the line. The cam cleats are usually both serrated so as to prevent the slippage of the line through the cleats in the reverse direction. In order to release such a line, the operator must pull the line further through the cleats in the initial direction, opposite the tension in the reverse direction, to relieve some of the force being exerted by the eccentric cams on the line, and then lift the line out from between the cleats off the center-line in a direction normal to the line tension. Under certain sailing conditions, when there is great line tension on the line, it is very difficult for a crewman to pull the line against such line tension and jerk it up and out from between the cam cleats, especially if the crewman is not positioned directly behind the cam cleat where he can use his weight to pull and jerk the line off line.

Examples of patents that require a line or rope to be lifted outside of the plane in which is the cam is mounted for movement include the following patent numbers: 626-0498; 4660 493; 4,361,938; 3,730,129; and 3,265,032.

In U.S. Pat. No. 4,278,042 a cam cleat is disclosed suitable for use on boats. The device includes two parts which face each other and are arranged to be spring loaded to adopt a free position but can be locked in a fixed position by an eccentric control device. The first part is pivoted in such a way that when rotated from the fixed position to the free position the line is arrested in the cam cleat.

In U.S. Pat. No. 4,217,847 a self-releasing cam cleat useful on sailboats and the like can be used to for maintaining sail lines taut However, in order to release the line must be slipped from the smooth gripping surface without the need for the operator to exert a force on the line to pull it away from the cam cleat as is usually done.

With some cleats of the type disclosed in the previous applications in the chain on which this application claims priority significant force couples are created when the line is locked by an internal cam, which tends to separate or "lift" the cleat from the surface on which the cleat is mounted. In some previously disclosed embodiments this problem was addressed by enlarging the size of the housing or frame. However, this approach results in housings or frames that were enlarged for only this reason and rendered the designs impractical for some applications where space for mounting the cleat became a factor.

SUMMARY OF THE INVENTION

Accordingly, an object of the present invention to provide a failsafe device for raising/lowering articles which does no have the disadvantages inherent in prior art devices.

It is another object of the invention to provide a failsafe device of the type under discussion which is simple construction and economical to manufacture.

It is still another object of the invention provide a failsafe device as in the previous objects that is simple convenient to use.

It is yet another object of the invention provide a failsafe device of the type suggested the previous objects that ensures safe operation and substantially instantaneously arrests the movement of the article when the line is released independently of any actions or inactions taken by user.

It is a further object of the invention to provide a failsafe device as the previous object that may be used the raise/lower a number of articles having different sizes or shapes and suspended from one location or a number of location distributed or spaced from each other.

It is still further object of the invention to provide a raising/lowering device useful use with a wide variety of articles that are both light and heavy in weight, such as tools or paint or the like to the top of a scaffold or ladder.

It is yet a further object of the invention to provide a cleat for selectively gripping and arresting a line passing therethrough while allowing quick-release of the line.

It is yet a further object of the invention to provide a device of the type under discussion which promotes release of the cord or line when the article is to be released and which reduces the risk of the cam locking up in its line holding position.

It is desirable, especially when sailing in competition, to be able to release a sail sheet from a cam cleat from any position, and to do it quickly and with a minimum amount of jerk.

Consequently, it is the object of this invention to provide a self-releasing cam cleat which does not require a heavy pulling on the line against the line tension in order to release it. It is another object of this invention to provide a cam cleat which may be released from virtually any position.

It is another object of this invention to provide a cam cleat which does not require additional release mechanisms such as levers or very intricate shapes but rather, is made up of a pair of cams generally attached to a base plate.

In order to achieve the above objects as well as others which will become apparent hereinafter, a failsafe cleat, with automatic in-line line-locking, comprises a frame having proximate and a remote sides on substantially opposite sides of said frame and formed with a passageway, extending between said proximate and remote sides, for receiving a line and generally defining a cleat center line along which a line can move along a first line releasing direction from said proximate to said remote sides and a line pulling direction from said remote to said proximate sides; attaching means for attaching said frame to a support surface; cam means on said frame on one side of said passageway and having a line engaging portion spaced a predetermined distance from the support surface, said cam means being movable between a line releasing position and a line locking position; a pusher on said frame on an opposite side of said passageway in relation to said cam means for selectively applying a force on the line in the direction of said cam means; cam biasing means tending to urge said cam means to disengage from the line; pusher biasing means normally tending to move the line across said gap into contact with said cam while permitting the line to return to said passageway out of contact with said cam means when sufficient tension is applied by the user off said cleat center line to create a force component to offset the pushing force created by said pusher biasing means thereby promote unlocking of the line and allow the line to move in said first line releasing direction, engagement of the line by said cam means to said line locking position creating a force couple which is a function of said predetermined distance that tends to separate said frame from the support surface; and stabilizing means for compensating for and offsetting said force couple independently of the dimensions or configuration of said frame.

BRIEF DESCRIPTION OF THE DRAWINGS

The invention will now be described in detail in conjunction with the drawings, which illustrate presently preferred embodiments of the invention.

FIG. 40 is an illustration of a latter leaning against a building structure and that the manner in which a cleat in accordance with the invention may be supported by the ladder to raise or lower objects such as tools, paint or the like;

FIG. 44 is a schematic side view of cleats of the type shown, for example, in FIG. 33, and illustrating the force couple typically created upon the locking or stopping of the line that tends to separate or "lift" the cleat from the mounting surface;

FIG. 45 is a front elevational view of a modified cleat design, with upper or outside wall removed, that compensates for the force couple mentioned in relation to the previous Figure substantially independently of the size or shape of the cleat housing or frame; and FIG. 46 is a schematic side view similar to the one shown in FIG. 44, but showing the manner in which the force couple is compensated for to stabilize the cleat on the mounting surface.

DESCRIPTION OF THE PREFERRED EMBODIMENTS

Figure 1:
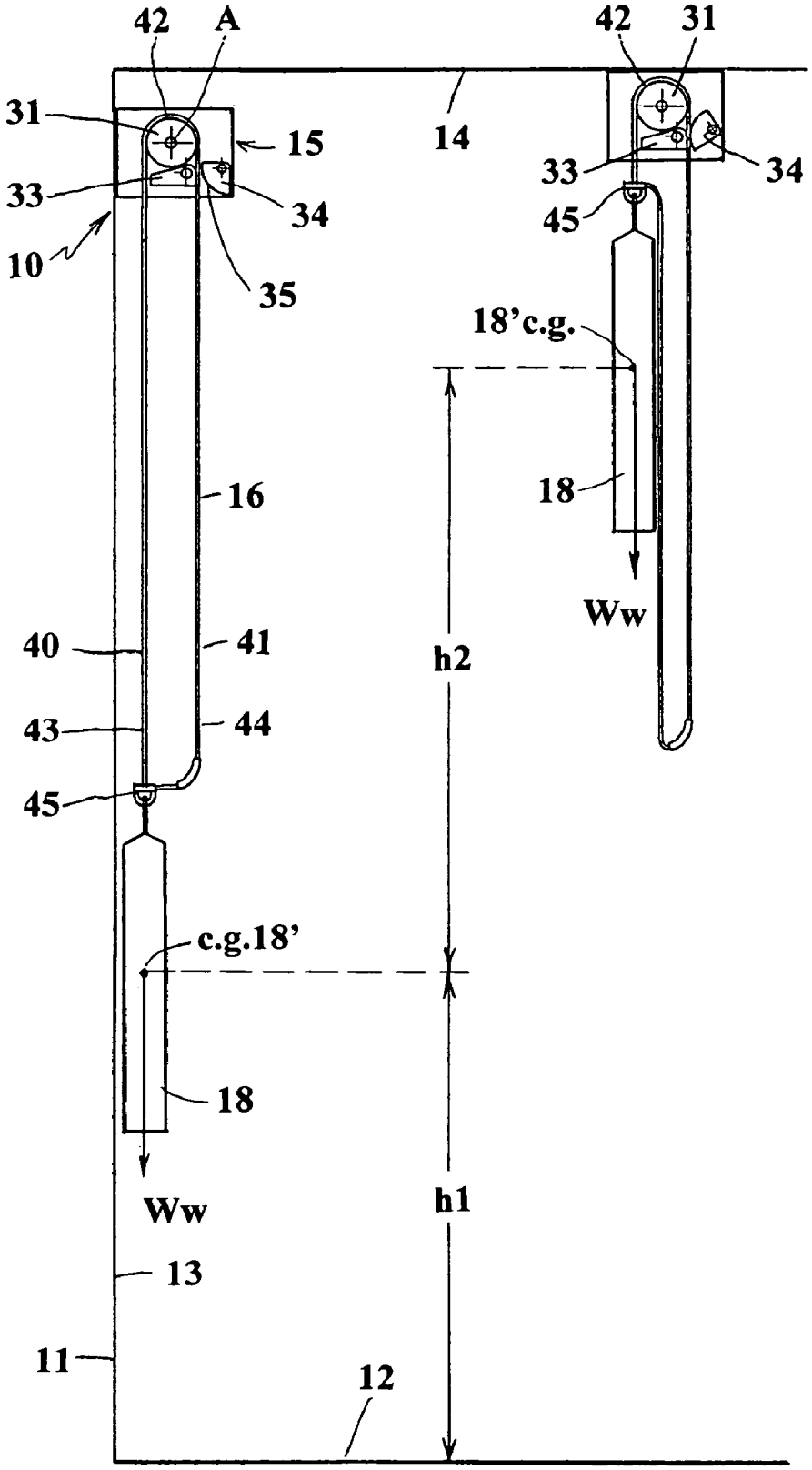
FIG. 1 is schematic representations of one failsafe device in accordance with the invention mounted on a wall and another mounted on the ceiling, illustrating an article raised to different levels above a floor or reference level, illustrating lower ends of the pulling side and the lifting side of the line of tied or joined together.

Referring now specifically to the figures, in which identical or similar parts are designated by the same reference numerals throughout, and first to FIG. 1, a failsafe lifting device in accordance with present invention is generally designated by the reference numeral 10.

The lifting device 10 is primarily intended to be used within a room or enclosure 11 that has a floor 12, which serves as a reference height, a wall 13 and/or a ceiling 14. The lifting device 10 consists of two major components, a pulley assembly 15 and a line, cord or rope 16.

Figure 2:
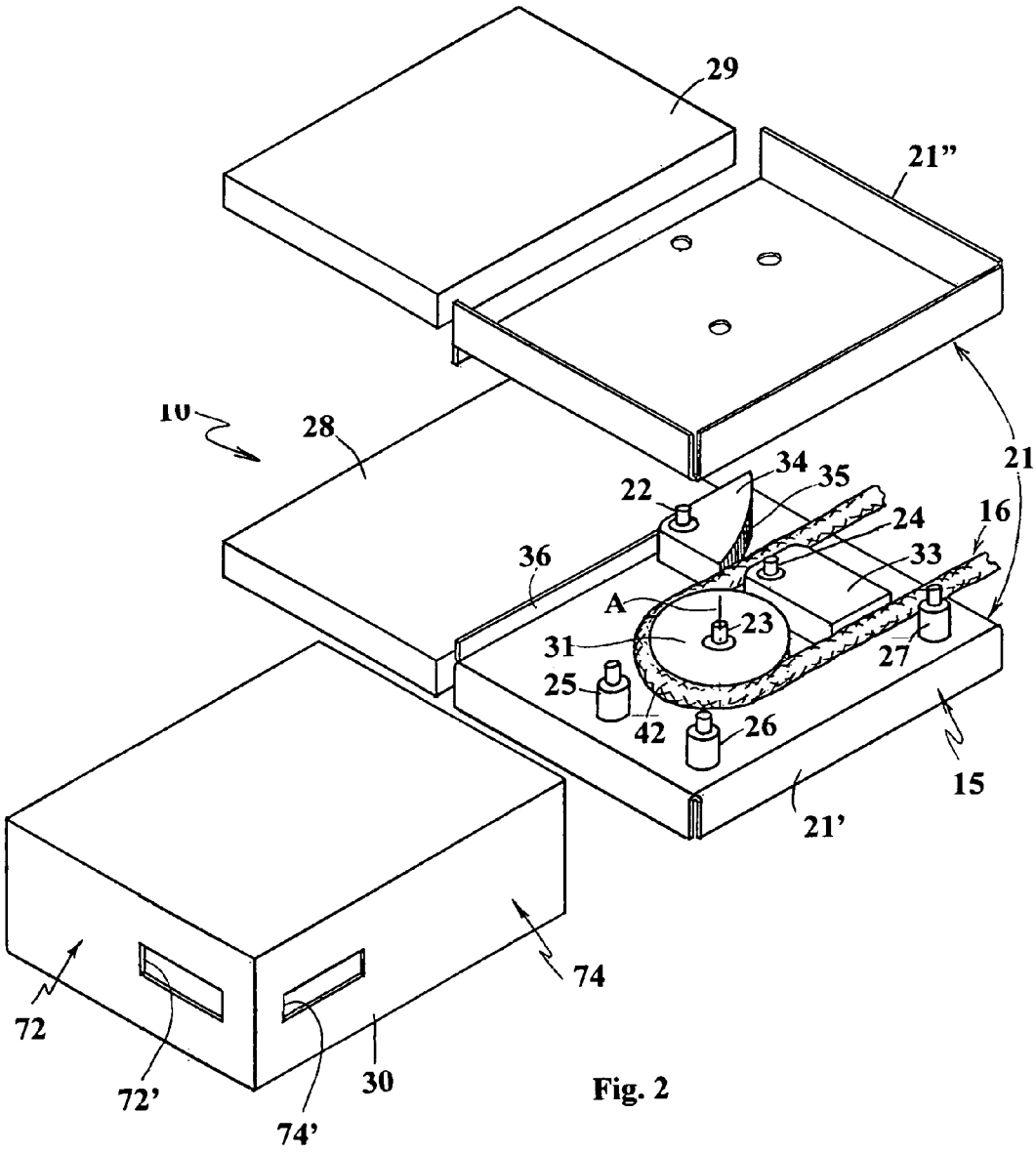
FIG. 2 is an exploded view, in perspective, of a device in accordance with the invention, shown disassembled to indicate the component parts.

Referring also to FIG. 2, the pulley assembly 15 includes a frame 21 comprising opposing like support panels 21', 21" and suitable attaching means, to be described, for attaching the frame 21 to a support surface, such as the wall 13 or the ceiling 14 above the floor 12 above which an article 18 is to be selectively elevated. The article 18 is in the form of a load or weight that has a centre of gravity 18' through which a weight component Ww extends. The panels 21', 21" are shown formed of sheet metal, although other materials can be used. With the construction shown the exterior surfaces of the panels form spaces preferably filled with filler panels 28, 29 to form a generally solid exterior surface to both increase the aesthetic appearance of the unit or device and to facilitate the attachment of an exterior cover, as to be described.

A low friction deflection means 31 is mounted on the frame 21 about a substantially horizontal axis A when the frame is mounted on a support surface. The specific nature of the low friction deflection means 31 is not critical and any such means may be used. In the presently preferred embodiments, such low friction deflection means is in the form of a pulley or sheave. However, a smooth pin or roller may also be used, with different degrees of advantage. A line, cord or rope is entrained over the sheave 31 and has a substantially vertical lifting line portion 40, attachable to the article 18 to be lifted, and a substantially vertical pulling line portion 41 is arranged to be pulled downwardly by a user to elevate the article and released or raised upwardly to lower the article.

Figure 3:
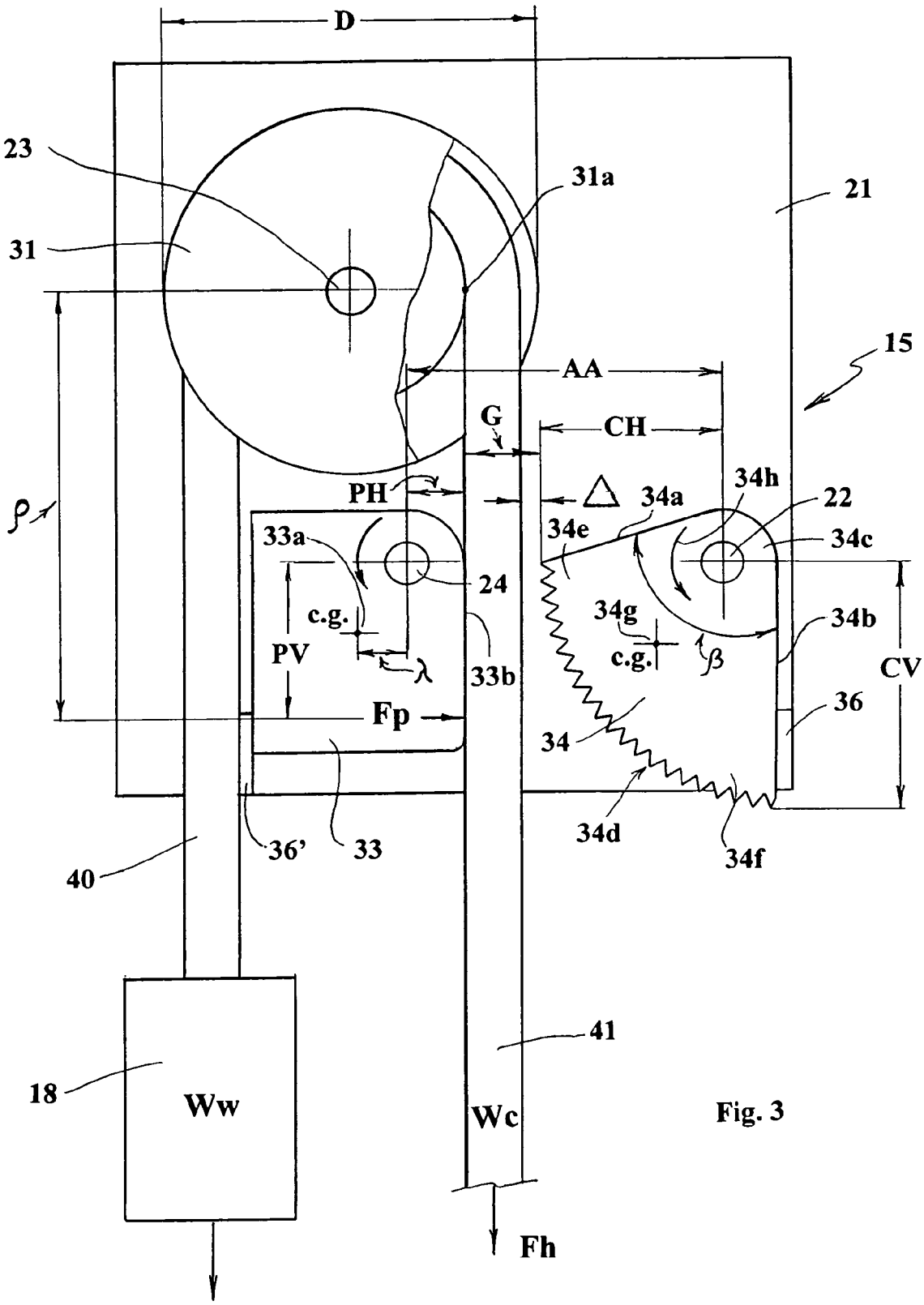
FIG. 3 is an enlarged side elevational view of a device in accordance with the invention, shown in the condition where a pulling force or tension is applied by the user during raising or lowering of an article and the cam is out of contact with the line.

Referring to FIGS. 2 and 3, a cam 34 is pivotally mounted on one side of the pulling line portion 41 about a pin 22. The cam is generally shown to be in the form of a triangular segment having shorter and longer sides 34*a*, 34*b*, respectively, that form a vertex 34*c* having an angle β equal to somewhat less than 90 degrees. However, the specific angle is not critical. The triangular segment also includes an outwardly bowed, arcuate side 34*d* opposite the vertex, the shorter and longer sides 34*a*, 34*b* being proximate to the first and second engaging portions 34*e*, 34*f*, respectively, of the cam. The center of gravity 34*g* of the cam is disposed between the pulling line portion 41 and pivot pin 22 so that the cam normally and naturally always tends to pivot in a counter-clock wise direction about the pivot in 22, as suggested by the arrow 34*h*, out of engagement with the pulling line portion. A limit stop prevents the cam 34 from pivoting counter-clockwise direction beyond the position shown in FIG. 3 in which the first engaging portion 34*e* of the cam engaging surface 34*d* is spaced a distance or forms a distance from the pulling line portion 41. The condition shown in FIG. 3 exists when a tension or force Fh is applied to be pulling line portion 41 to overcome the weight Ww of the article 18. It is important that the distance $\Delta>0$, although such distance may typically be within the range of 1 mm. In the position shown in FIG. 3 the cam 34 is in a line releasing position. However, the cam 34 may be pivoted in a clockwise direction by causing the pulling line portion 41 to engage the first engaging portion 34*e* along the initial or upper end of the surface 34*d* and urging the surface upwardly (as viewed in FIG. 3) while the pulling line portion 41 continues to move upwardly to a position shown in FIG.

Figure 9:
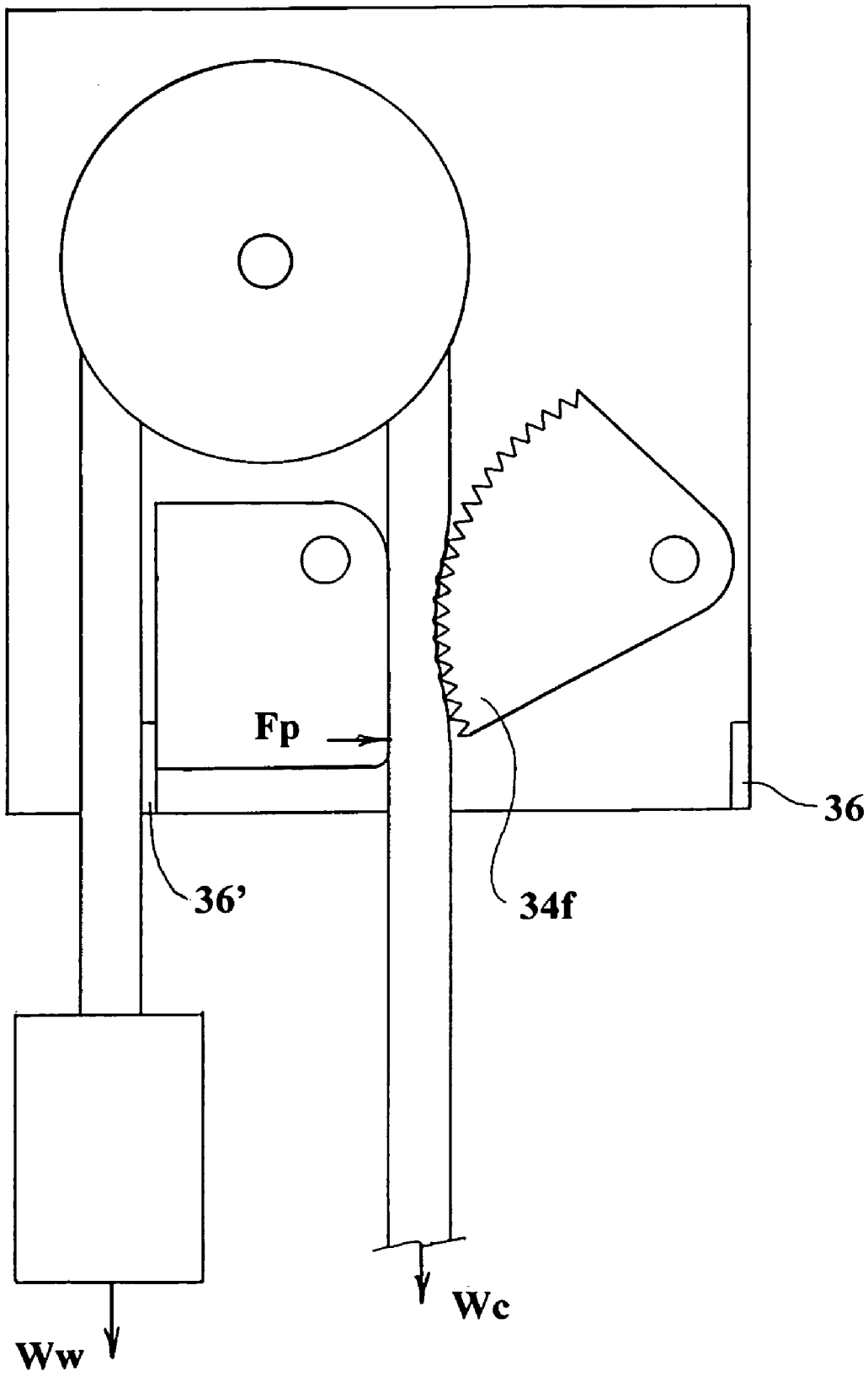
FIG. 9 is similar to FIGS. 3 and 8 illustrating the forces acting within the device just prior to the point when the pulling line portion is fully arrested or locked.

8 to ultimately cause the second engaging portion 34*f* to bridge the distance Δ, as shown in FIG. 9, for compressing, gripping and substantially instantaneously arresting the pulling line portion 41 and preventing it from moving upwardly toward the pulley or sheave 31 and corresponding downward movement of the article 18.

In order to insure that the pulling line portion 41 automatically and almost instantaneously engages the initial engaging portion 34*e* of the surface 34*d*, there is provided, proximate to the shorter side 34*a*, a pusher 33 on an opposing side of the pulling line portion 41 in relation to the cam 34 for always and continuously applying a force Fp to the pulling line portion 41 in the direction of the cam 34 (towards the right as viewed in FIG. 3) and for urging the pulling line portion transversely (horizontally) across the clearance or distance Δ into contact with the first engaging portion 34*e*, only when tension in the pulling line portion is decreased relative to the tension in the lifting line portion. Continued contact between the pulling line portion 41 and the line engaging surface 34*d* while the line portion moves upwardly causes the second engaging portion 34*f* to bridge the clearance distance Δ while the cam 34 moves from the releasing condition shown in FIG. 3 to the locking condition shown in FIG. 9 - a condition that continues until a tension is applied by the user to the pulling line portion 41 that substantially corresponds to the weight Ww of the article 18. In the preferred embodiment, the pusher 33 and cam 34 are on diametrically opposite side of the pulling line portion 41, both being substantially in the plane of the sheave 31. Other relative positions of these components are, however, possible. As shown, the pusher 33 is presently mounted on a pivot pin 24 having an axis substantially parallel to the axis of the pin 22 and to the axis of the pin or shaft 23 on which the sheave 31 is rotatably mounted.

While in theory the pusher 33 and the cam 34 can be vertically spaced a considerable distance from the sheave 31, in the presently preferred embodiment these elements are in close proximity to the sheave for two primary reasons. The first is that this makes it possible to produce a compact pulley assembly 15. Additionally, as will be evident, the smaller the distance ρ between the tangent point 31*a* (FIG. 3) at which the pulling line portion 41 first makes contact with the sheave and the point at which the pusher 33 applies its biasing force Fp quicker that the device will respond when the user releases the line pulling portion. Thus, if the diameter of the sheave is D, it is preferable that the pusher and cam 33,34 be horizontally spaced from each other and the pin 24 be spaced from the shaft 23 a distance on the order of magnitude of the diameter D of the sheave. The arcuate or bowed surface 34*d* is preferably non-smooth and provided with a Friction generating finish that frictionally engages the line on contact therewith when the pulling line portion 41 moves upwardly towards the sheave 31. Such friction generating surface is shown in the form of short teeth in FIG. 3. Any other non-smooth or tacky surface, such as the use of knurling, can also be used.

As noted, the cam 34 is eccentrically mounted so that it has a tendency to normally rotate in a counter-clockwise direction until it is halted by a limit stop 36. Similarly, the pusher 33 is mounted eccentrically about the pin 24 as shown. The specific shape or configuration of the pusher 33 is not critical, as long as it does not contact or interfere with the lifting line portion 40 and the center of gravity 33*a* is placed to the left the pin 24 axis a distance so that the pusher 33, as well, has a tendency to normally and continuously rotate or pivot in the counter-clockwise direction. To assure that the pusher 33 does not interfere with the lifting line portion 40 an optional limit stop 36" may be provided between the pusher and the line portion, particularly when these elements are in close proximity in a compact pulley assembly as shown in FIG. 3. Since the cam 34 and the pusher 33 are on opposite sides of the pulling line portion 41 the pusher 33 always tends to rotate into abutment with the pulling line portion 41 whereas the tendency of the cam 34 is to move away from such pulling line portion. More specifically, the pusher 33 has a preferably flat and smooth or frictionless line engaging surface 33*b* that faces the pulling line portion 41 and the cam in the direction of the cam 34. An important feature of the invention that such tendency or inclination of the pusher 33 force Fp to move the pulling line portion 41 into contact with the cam 34 occurs independently of the tension in the line. As will be described, however, the effectiveness of such pusher in moving the line portion 41 laterally, in a direction generally normal to its longitudinal length direction, at any given time will be a function of the tension in the line.

Distance AA between the axes of the cam and the pusher is equal to the sum of the distances, along a horizontal line as viewed in FIG. 3, of the G, the distance PH of the pusher axis to the pulling line portion 41 and the distance CH of the first engaging portion 34*e* at the edge 34*a* and the axis of the pivot 22. Also, the distance G between the line engaging surface 33*b* of the pusher and the first engaging portion 34*e* of the cam, at 34*a*, is substantially equal to the diameter of the pulling line portion 41 and distance Δ. The vertical line engaging surface 33*b* has a length along the pulling line portion 41 a distance PV greater than the sum of the distances PH and Δ. Additionally, the sum of the distances CH and Δ is less than the length CV of the side 34*b*, or the longer side of the cam. Further, the length CV is less than the sum of the length CH and G. These general relationships ensure that the cooperative normally operate to achieve the desired results.

An exterior cover or case 30 (FIG. 2) is preferably provided that covers or encloses the operative components in the pulley assembly. The cover or case may be decorative, as it will normally be the only component, with the exception of the lines, that will be visible within the enclosure or room. The cover or case includes peripheral walls including top wall 72 and side wall 74. A slot 72' is formed in the top wall 72 generally proximate to pin 25 to make it accessible through the slot. Similarly, a slot 74' is formed in the side wall 74 proximate to the pin 26 so that it is accessible. The attachment bolts are extended through one of the slots to selectively attach to one of the pins 25, 26 without the need to remove the cover.

Figure 4:
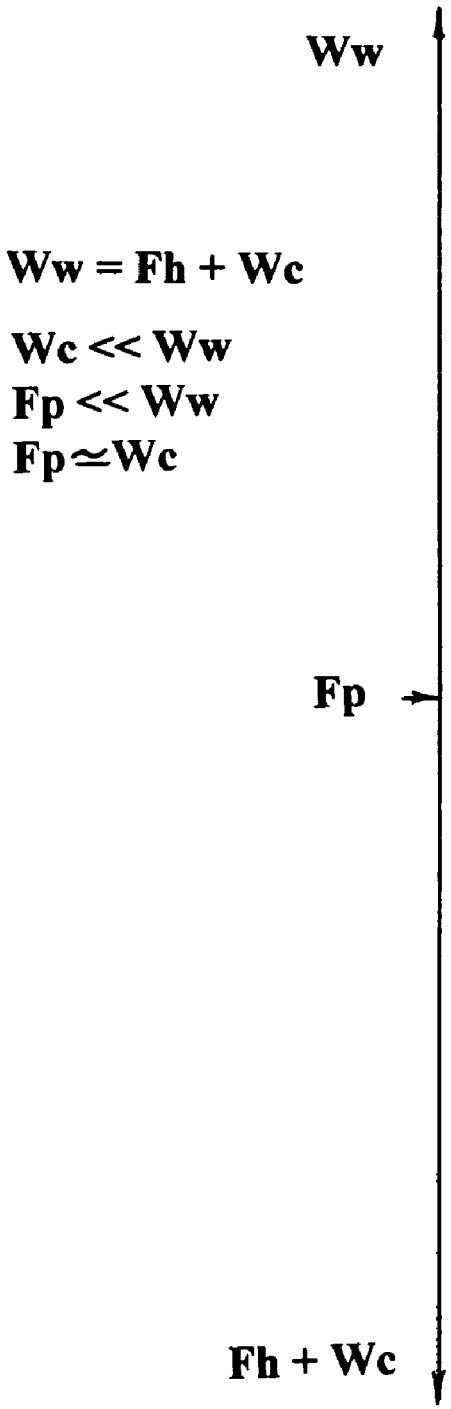
FIG. 4 is a force diagram corresponding to FIG. 3.
Figure 6:
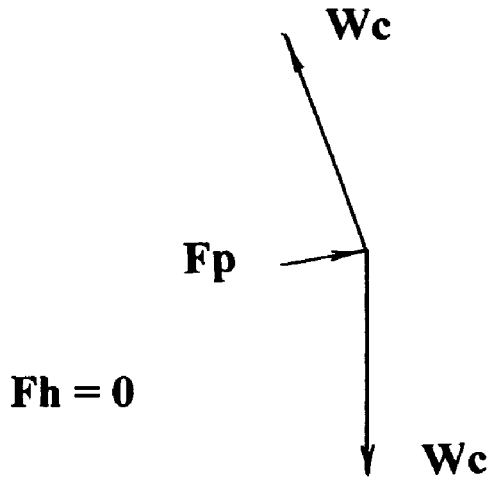
FIG. 6 is similar to FIG. 4 when the pulling force or tension applied by the user is removed and, therefore, the pulling line portion is released.
Figure 5:
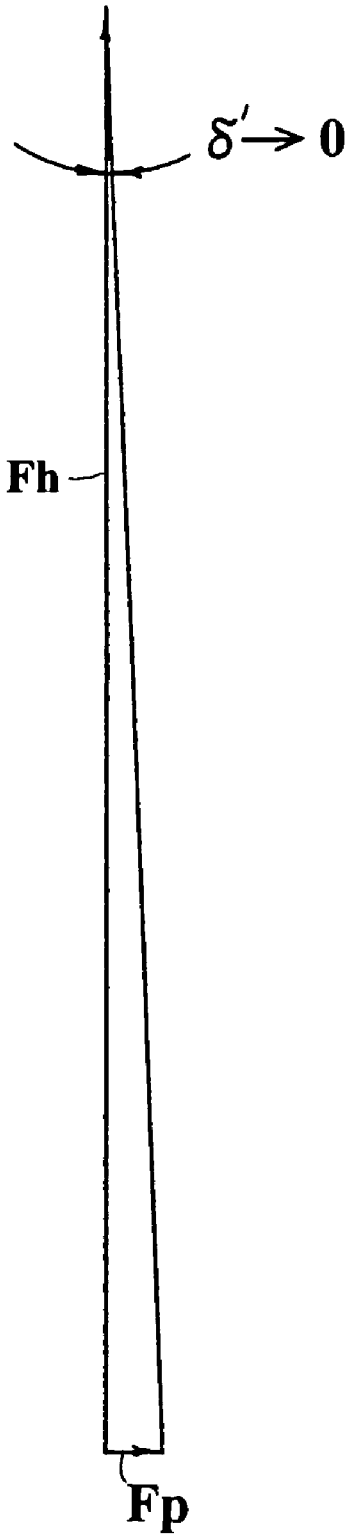
FIG. 5 is an exaggerated deflection diagram corresponding to the upper end of the force diagram shown in FIG. 4 to illustrate the deflection appliline when tension or pulling forces are applied to the line by the user as shown in FIG. 3.
Figure 7B:
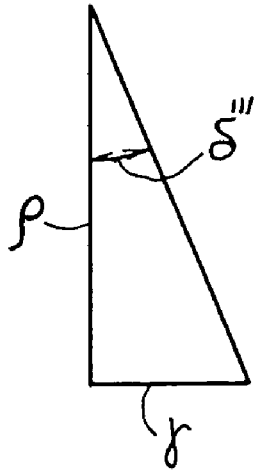
FIG. 7*b* is a physical deflection diagram corresponding to the force diagram shown FIGS. 6 and 7*a;*
Figure 7A:
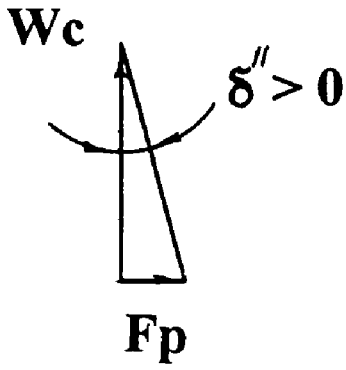
FIG. 7*a* is similar to FIG. 5 but corresponding to FIG. 6 when the pulling force or tension is eliminated.
Figure 8:
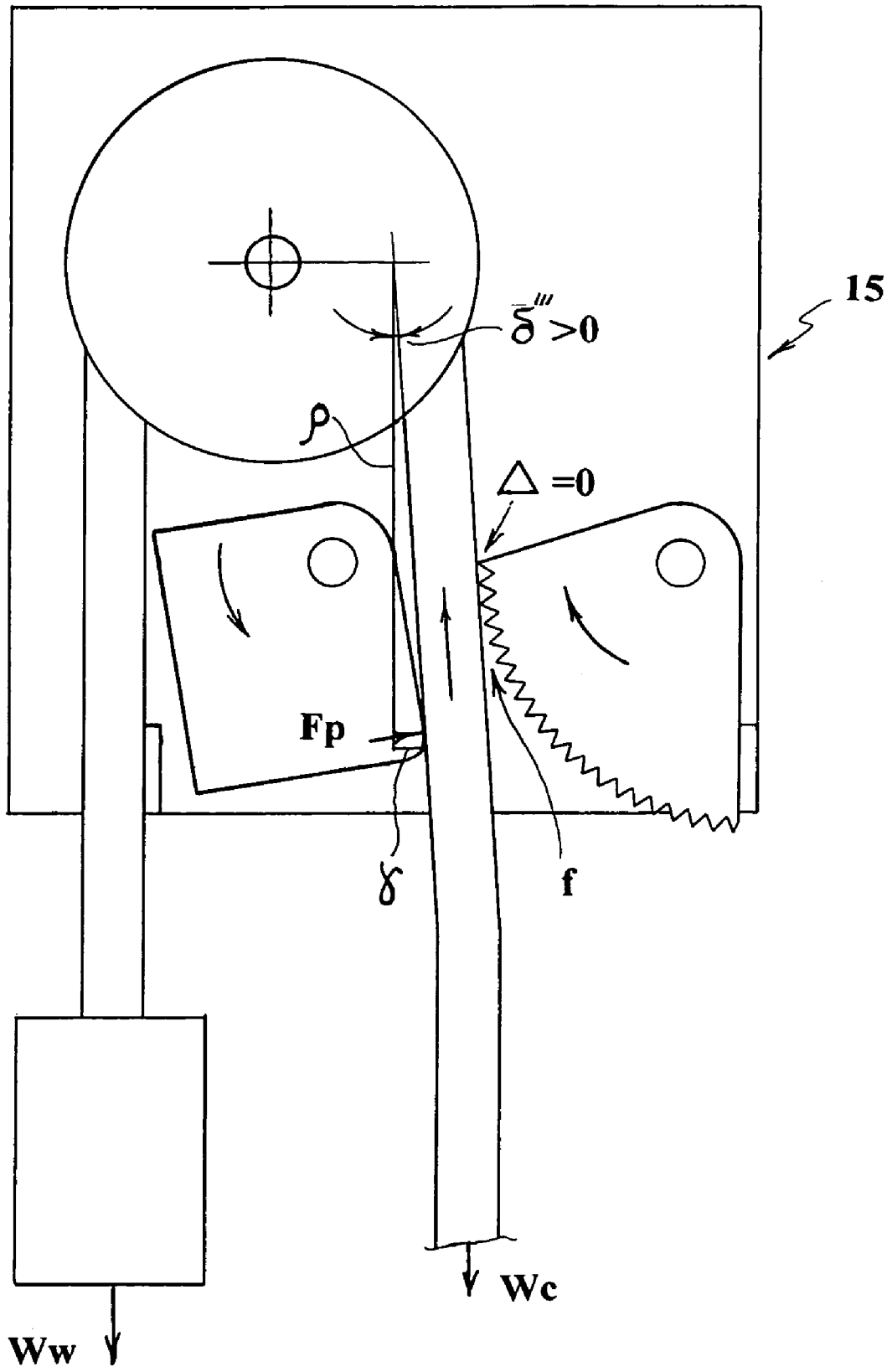
FIG. 8 is similar to FIG. 3 buy showing the condition when the line is initially released and the pusher urges the line to engage the cam while the pulling line portion moves upwardly to cause to cam to rotate or pivot in a clockwise direction to wedge the line and arrest its continued upward movements.

Referring to FIG. 3, forces or tensions developed within the pulling line portion 41 are depicted. At the top of the line, where it engages the sheave, an upward force is applied to the pulling line portion to offset the weight Ww of the article and the weight Wc of the pulling line portion 41. Clearly, the weight Wc is extremely small compared to the weight Ww of the article, and the downward force Fh applied by the user. From FIG. 5 it will be clear that the force Fh is so much greater than the pushing force Fp that the angle δ' approaches zero and is virtually undetectable. In FIG. 4, therefore, the forces are shown to be substantially aligned along a straight line and without any detectable deflection. In the exaggerated force diagram shown in FIG. 5 the angel δ' defined by the force vectors is shown to approach zero. However, as soon as the user releases the pulling line portion 41 the tension or force Fh is eliminated and the only force acting downwardly is the weight Wc of the line. Since the weight Wc and the pushing force Fp are much closer in magnitude (FIG. 6) the resulting angle δ" (FIG. 7*a*) defined by the force vectors becomes a more significant quantity and must be selected so that the pulling line portion 41 is shifted a distance γ the towards the right, as viewed in FIG. 7*b*, at least a distance sufficient to cause at least that portion ρ(FIG. 3) of the pulling line portion 41 to bridge the initial distance Δ and for coming into engagement with the initial engaging portion 34*e* of the cam surface along the side 34*a* and forming a real angle δ'". It should also be evident that such portion 41 moves upwardly as shown in FIG. 8 in reaction to the dropping of the article 18. Once the vertical pulling line portion 41 is in contact with the cam, as shown in FIG. 8, continued upward movement of such line portion with continued biasing by the pusher 33 maintains such engagement with the cam and causes the cam to rotate in a clockwise direction. In doing so, successive portions of increasingly larger radii engage the line and wedge the line between the cam surface 34*d* and the pusher 33. This continues until the condition shown in FIG. 9 is reached where the cam 34 is in the maximum clockwise position and the pulling line portion 41 is typically substantially fully compressed between the pusher and the second cam engaging portion 34*f*. Once the cam can no longer compress the line it will be fully wedged in place. The pusher and cam act very swiftly in moving from the initial position shown in FIG. 3 to the position shown in FIG. 8 and, ultimately, in FIG. 9. This is ensured by selecting a cam and pusher that have very low masses and, therefore, low inertia. These components, therefore, are extremely responsive and exhibit minimal delays in moving from one position to another. In this connection the cam and the pusher can be made from any suitable material, such as metal or plastic, as long as the pusher 33 can develop a force Fp, under the action of gravity, sufficient to overcome the weight Wc of the pulling line portion 41 and move it transversely across the distance Δ into contact with the cam 34.

Importantly, movement of the pusher shifting the line portion 41 across the distance Δ into contact with the cam 34 is automatically achieved without any steps that need to be taken by the user. Thus, as soon as the user releases to pulling line portion 41 it is substantially immediately arrested to prevent the article 18 from dropping into any extended free fall. Furthermore, because the cam and the pusher act so quickly and all the components are so close to each other, the pulling line portion 41 is arrested almost immediately before the article 18 has on opportunity to develop any meaningful velocity and, therefore, momentum.

This assures that stopping of the article while in motion creates the least shock forces or stresses to the supporting surfaces-either a wall or ceiling. Thus, it has been observed that the movement of the article 18 weighing approximately 15 pounds can be arrested within approximately 0.05 seconds. If the instant device is supported in ½ inch sheet-rock, which can support 60 pounds, it will be clear that the force exerted on the ceiling will increase to a maximum of twice the weight of the article-substantially less than the maximum load bearing capacity for such sheet-rock to provide a considerable safety margin. Greater load can clearly be supported in sturdier support surfaces, such as ⅝" or ¾" sheet-rock. If the device is secured to a wood beam the safety margin is greatly increased and loads of up to 180 pounds does not present a problem, the line becoming the weak link in the chain and more likely to fail than the support surface. It is anticipated that typical articles to be supported by this device will weight the less than 10 pounds. With conventional device, which allow articles to drop 1–3 cm the maximum force on the support surface can increase as much as six times the weight of the article. This can result in serious damage to the support surface and/or the article and, more importantly, injury to the user or to others. The rapidly acting present invention, which minimizes the time that the article has to accelerate, therefore increases the maximum weight that can be supported by any given support surface. The device, therefore, is not only easier and more convenient to use, but is also more reliable and safer to use with heavier loads.

Figure 10:
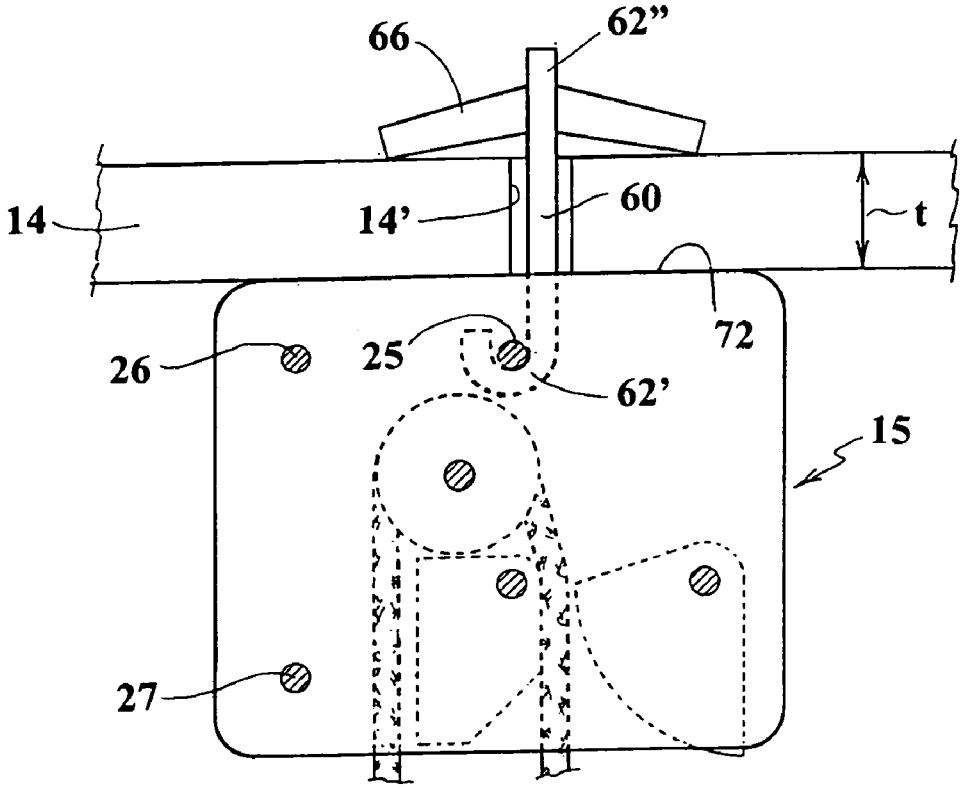
FIG. 10 is a side elevational view of the device, illustrating the manner in which it may be attached to a ceiling.
Figure 11:
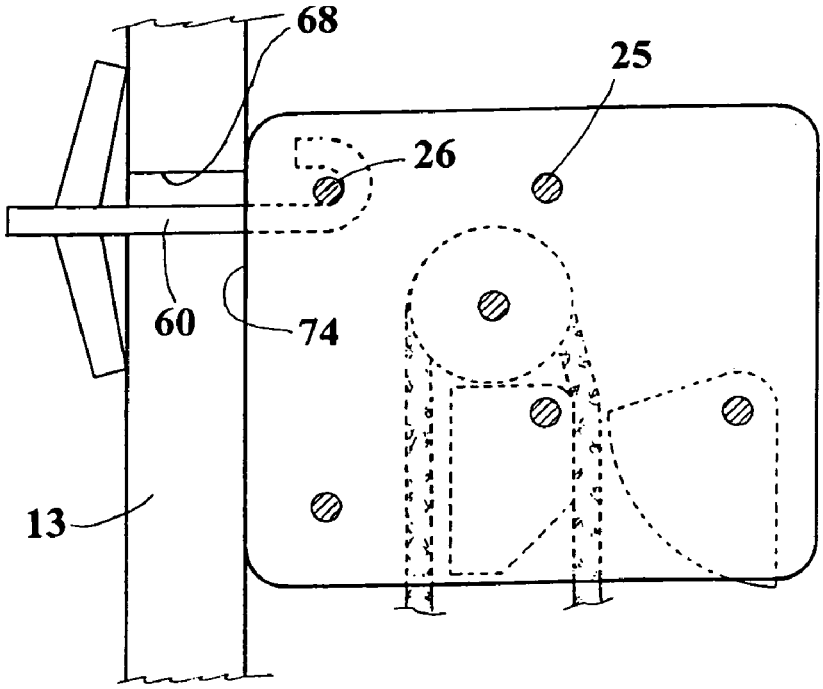
FIG. 11 is similar to FIG. 10 but illustrating the device mounted on a wall.

The specific manner in which the pulley assembly 15 is attached to the support surface is not critical and any suitable, conventional method may be used. Referring to FIG. 10, the pulley assembly 15 is shown mounted on a ceiling 14 having a predetermined thickness t, such as ½ inch sheet-rock. A hole 14' is formed in the ceilings for receiving a "J" bolt 60 having a hook 62' for engaging a transverse support pin 25 and a threaded end 62" which extends through the hole 14' for engagement with a butterfly knot 66. By rotating the assembly 15 it is drawn against the bottom surface of the ceiling 14 until the top or horizontal surface 72 of the device is tightly abutting the against it. In FIG. 11, a similar device is shown mounted on a wall 13 provided with a hole 68 through which the same attachment or fastener device extends and engaged with a transverse support pin 26 proximate to the side or vertical edge 74 of the assembly 15 and tightly secured to the surface on which it is mounted as described above.

Figure 12:
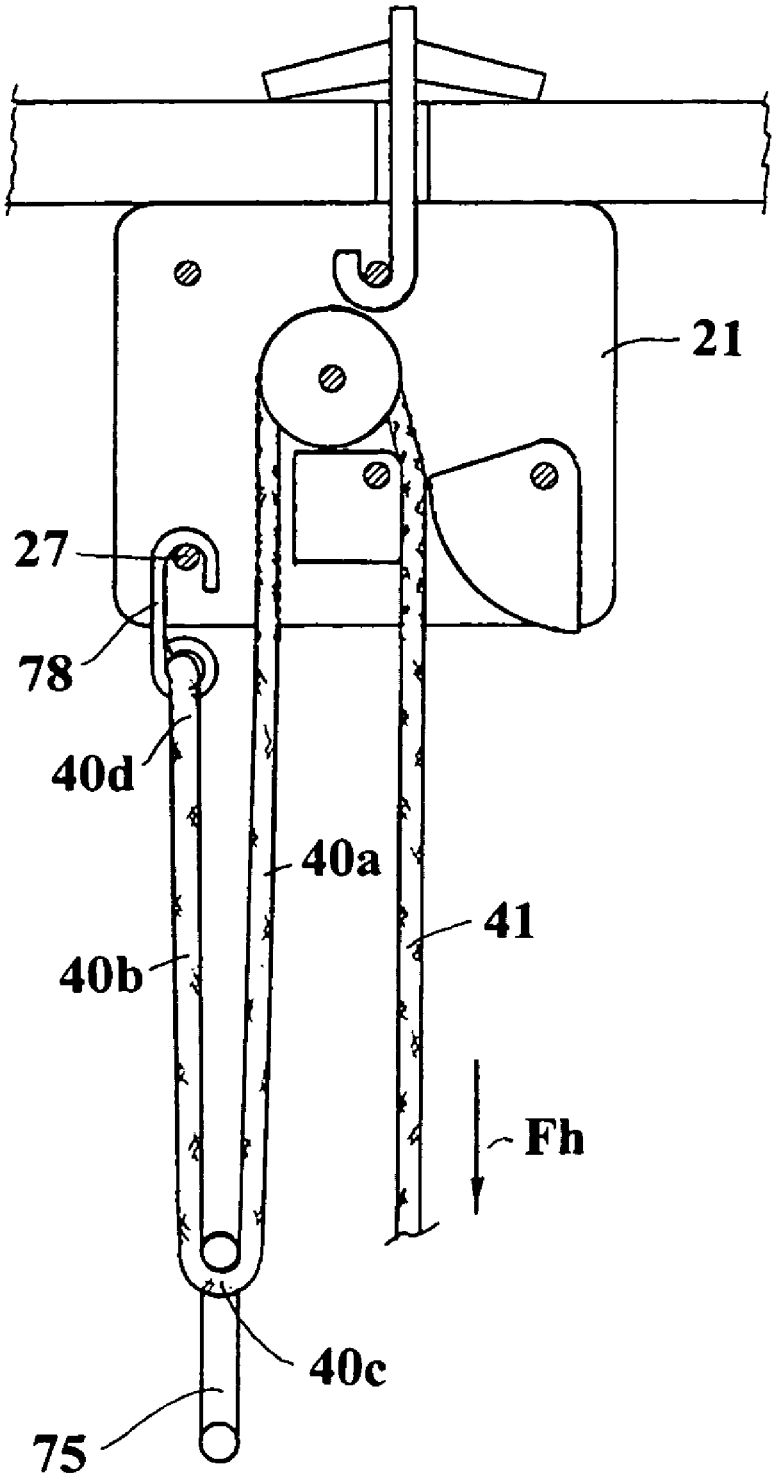
FIG. 12 is a side elevational view of the device in which the free end of the lifting line portion is attached to the device to support a ring that can be moved upwardly and downwardly and to which an article may be attached.

Referring to FIG. 12, it is sometimes desirable to suspend an article from a ring 75. In accordance with the embodiment shown in FIG. 12 the frame 21 includes a transverse pin 27 spaced from the sheave as shown, the pin 27 serving as the securing means for securing the free end of the lifting line portion 40 on the frame 21 to fold the lifting line portion 40 into two generally adjacent leg portions 40*a*, 40*b* joined at a lowermost point 40*c* which extends through and supports the ring 75. In FIG. 12, the free end 40*d* of the line portion 40 is secured to the pin 27 by means of any hook 78 attached to the free end 40*d*. It will be evident from FIG. 12 that pulling the line portion 41 downwardly causes the lowermost portion 40*c* to rise and raise the ring 75. In this case Fh=½ Ww due to the increased mechanical advantage provided by this arrangement.

Figure 19:
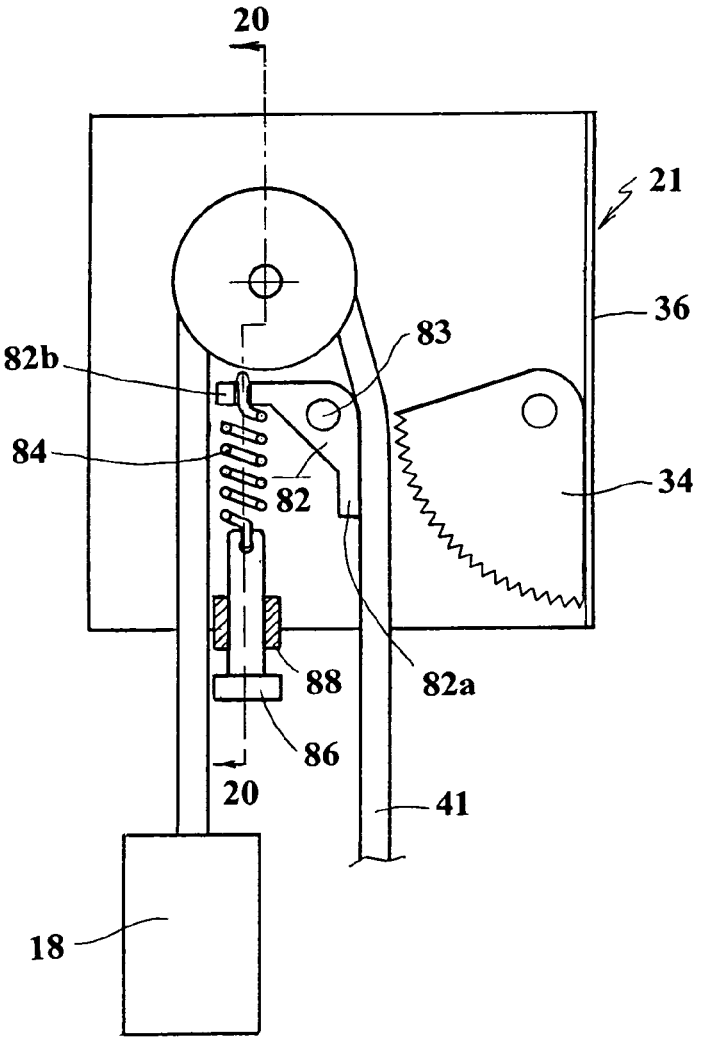
FIG. 19 is a front elevational view of a failsafe device in accordance with another embodiment of the inventions, in which the pusher is biased by a tension spring.
Figure 20:
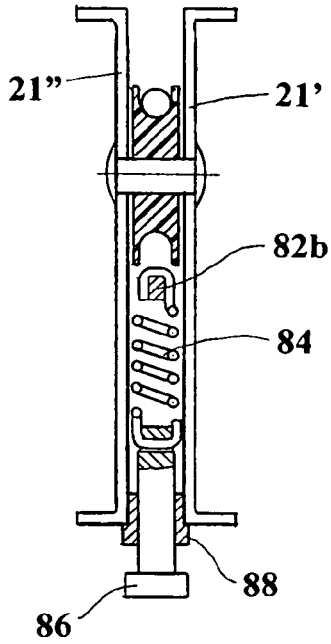
FIG. 20 is a cross-sectional view of the embodiment shown in FIG. 19, taken along line 20—20.
Figure 21:
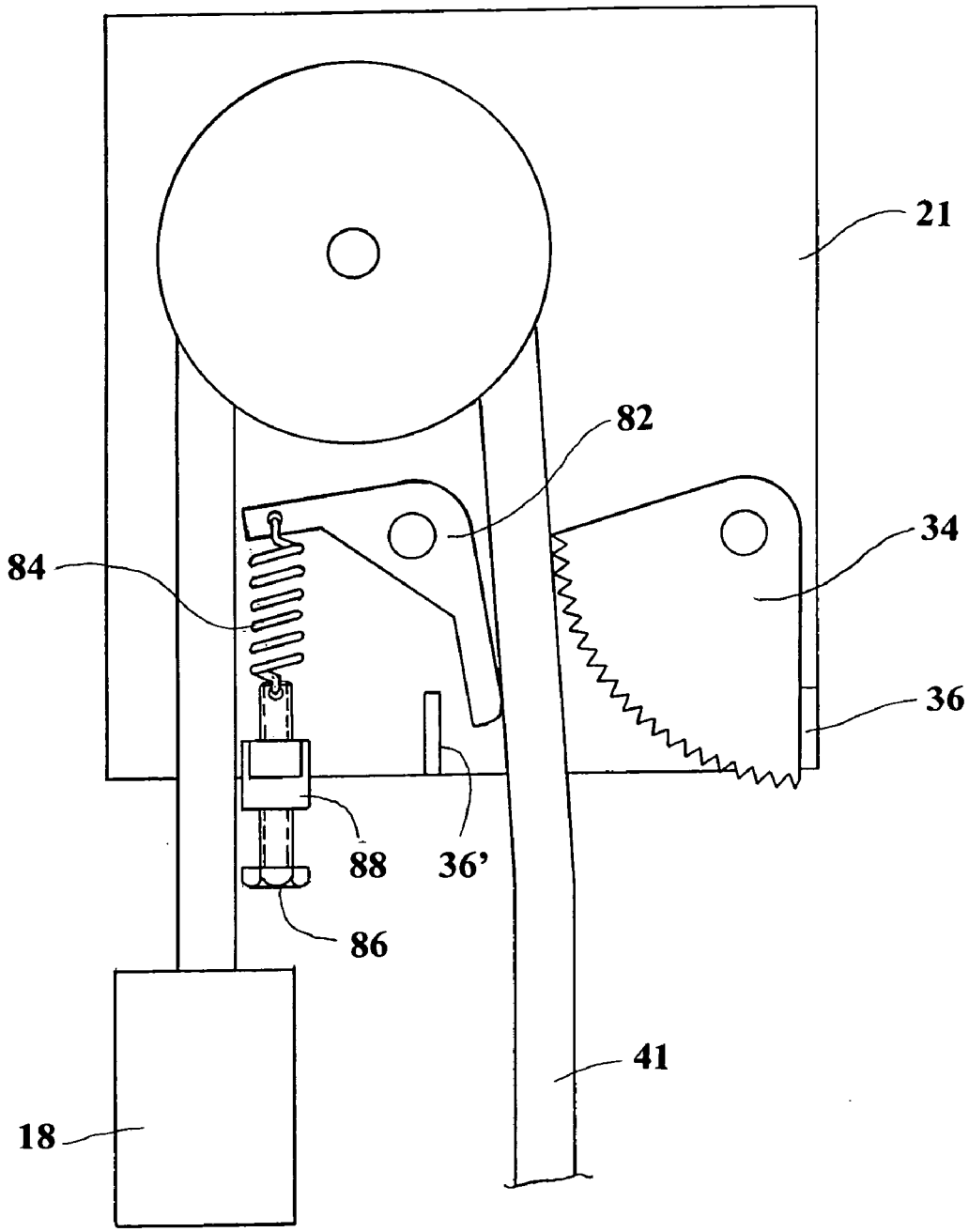
FIG. 21 is similar to FIG. 19 when tension on the pulling line portion is removed to enable the pusher to deflect the line into contact within the cam.
Figure 22:
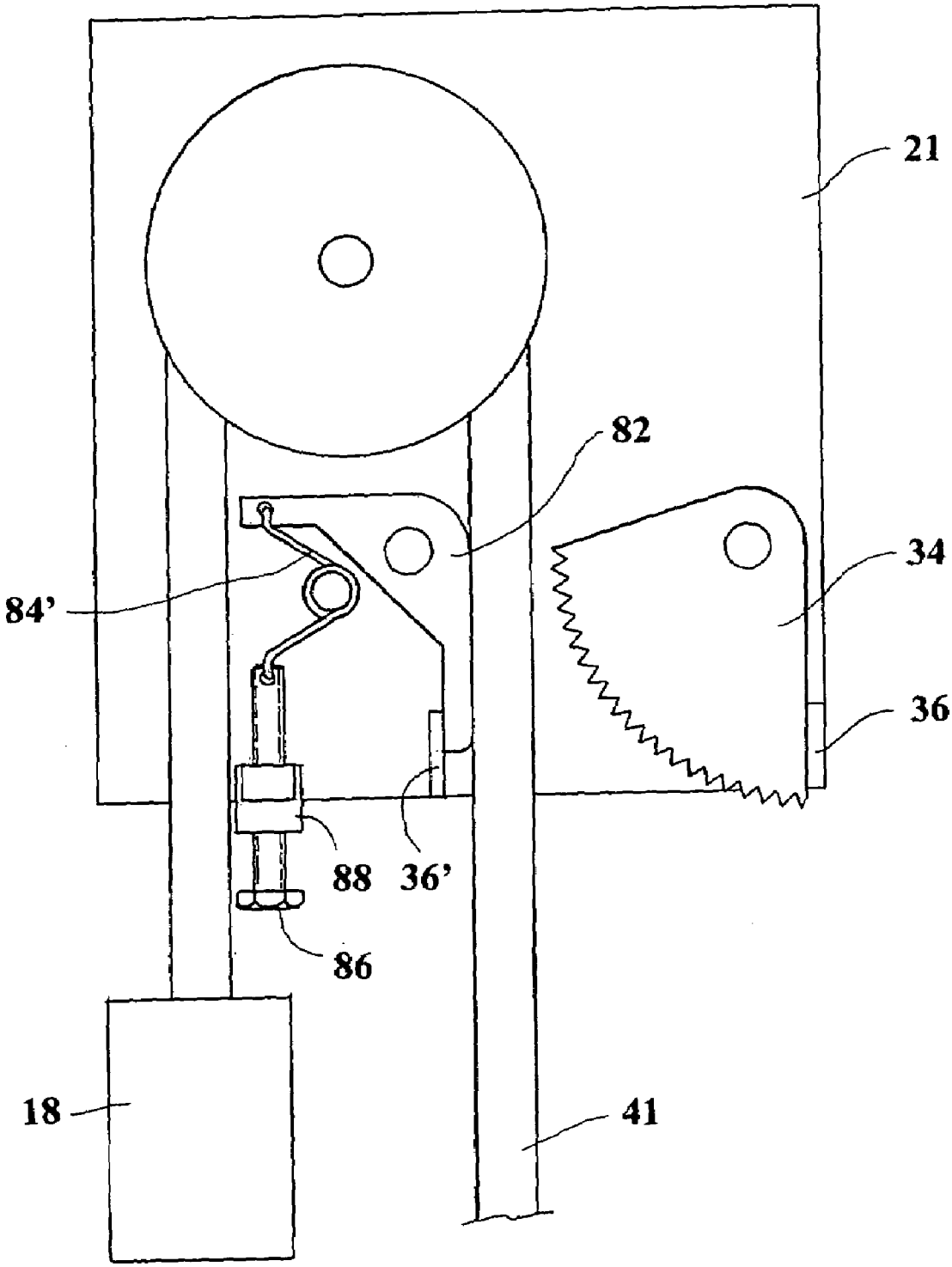
FIG. 22 is similar to FIG. 19, but illustrating a pusher employing a butterfly spring instead of a tension spring shown in FIGS. 19–21.

Referring to FIGS. 19 and 20, the pusher in accordance with another embodiment of the invention can include other pusher designs, such as pusher 82, shown as a triangular lever pivotally mounted on pin 83 and having one leg 82*a* in abutment with the pulling line portion 41, while the other leg 82*b* is arranged to be pulled a tension spring 84 having one end engaged with the leg 82*b* while the other end of the spring is secured to a retainer 86 which may be adjustably mounted on a support block 88 on the frame 21. It should be clear, in this arrangement the pusher 82 always urges the pulling the line portion 41 towards the cam 34, as with previous embodiment. The benefit of this second embodiment is that the tension in the spring can be adjusted at will to select a force Fp which will provide for optimum operation despite possible changes in variable parameters such as the different weights of various cords or lines that may be used. The operation is otherwise similar to that previously described, FIG. 21 showing the movement of the pusher 82 when the user releases the pulling line portion 41 to transversely displace it into contact with the cam. A similar arrangement is shown in FIG. 22, in which the tension spring 84 is replaced with a butterfly or left spring 84'.

Figure 13:
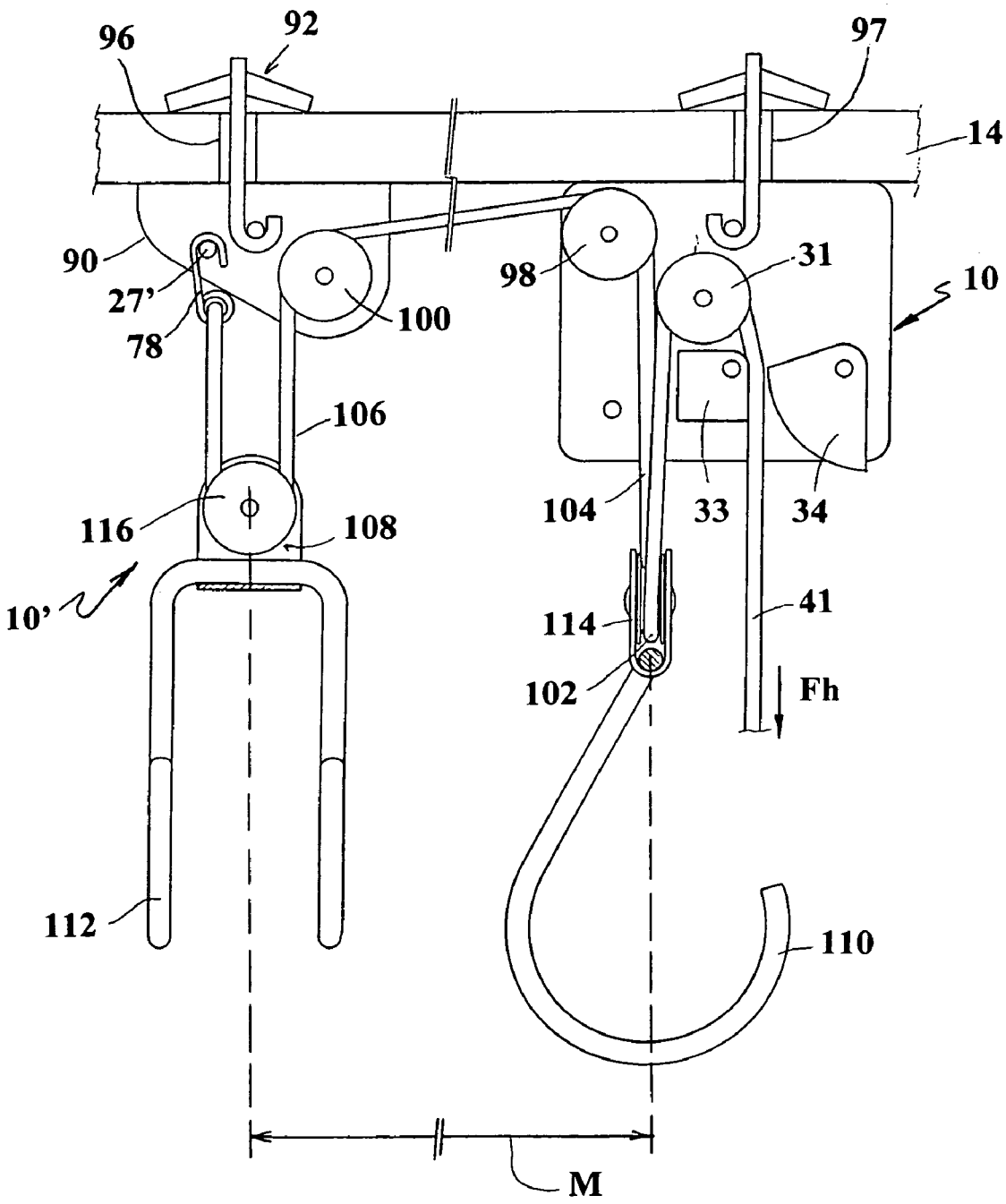
FIG. 13 is similar to FIG. 12, in which an accessory device is secured to a ceiling a distance spaced from the primary failsafe device, showing how the vertical lifting line may be engaged within the various pulleys to permit two hooks to be elevated simultaneously, this being useful in raising certain larger objects or articles such as bicycles.

In FIG. 13, a modified form of the device is shown for use with a larger article that must be simultaneously lifting at two different points horizontally spaced from each other a predetermined distance M. The modified lifting device 10' includes an auxiliary pulley assembly 90 secured to the ceiling 14 by means of an attachment member 92, similar to that used for attaching the device 10 to the ceiling 14, in spaced holes 96,97. Additional sheaves 98, 100 are similarly mounted as shown. As shown FIG. 13 a pin 27' is provided to which the free end of the line is secured by means of the hook 78. The lifting line portion is twice reversed upon itself to form suspended line portion 104, 106 as shown at both pulley assemblies to form lowermost portions 102, 108 to support additional sheaves 114, 116. It will be evident that each of the hooks 110, 112 are suitable for attaching to a tubular member of a bicycle so that the bicycle can be raised by pulling the line portion 41 by simultaneously raising both hooks 110, 112. It will be noted that in this arrangement, only the lifting device 10 includes a line locking or arresting mechanism including a pusher 33 and cam 34 since the line is continuous and arresting the line pulling portion 41, between the line and the movement of the suspended article from further movements as soon as the user releases pulling line portion 41, for reasons above described. In place of the hooks other engaging elements may also be used to accommodate differently shaped articles. Low friction pulleys facilitates the use of the compound device shown FIG. 13. In this case Fh=¼Ww.

Figure 14:
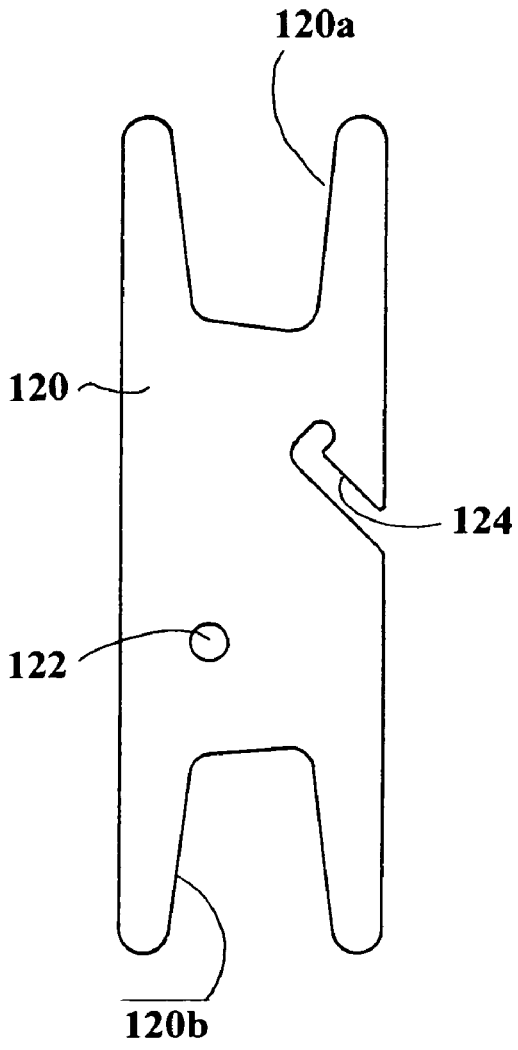
FIG. 14 is a front elevational view of a flat spool or line length adjusting plate in accordance with the invention on which excess cord or line can be wound and maintained.
Figure 15:
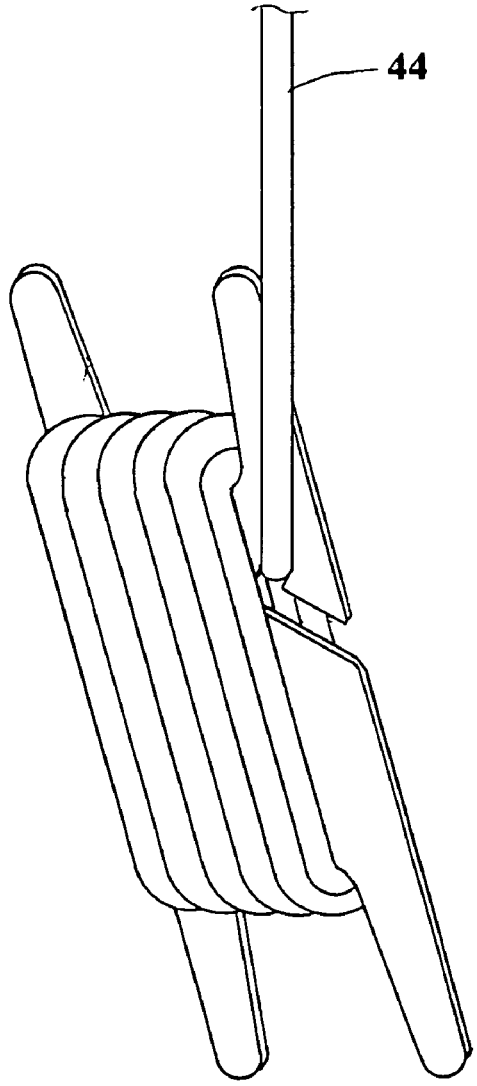
FIG. 15 is a perspective view of the spool shown FIG. 14, showing cord or line wound thereon.

Preferably, a spool is used to avoid excess hanging line when the pulling line portion 41 is used to raise the article as shown in FIG. 1. Referring to FIGS. 14, 15 a flat spool 120 is shown that can be used to accumulate excess line. The flat spool 120 includes two opposing, generally U-shaped cut-outs 120*a*, 120*b*, a hole 122 and an irregular slot 124 as shown. The free end of the line is inserted through the whole 122 after which the line is wound about the spool as shown in FIG. 15. Once the suitable amount of line has been wound around the spool the line can be the inserted into the L-shaped slot 124 to positively lock and retain the line therein and prevent unwinding. While the locking mechanism in the preferred embodiment is in the form of at least one generally L-shaped slot 124 in the flat plate 120 it will be clear that any locking means can be used for this purpose, such as differently shaped slots, a clip attached to the plate or the like. In FIG. 1, the free end of the pulling line portion 41 is attached to the free end of the lifting line portion 40 by means of the tie or clip 45. However, this approach forms a closed loop that may be dangerous to young children. Prior art clips that exhibit such problems are disclosed in U.S. Pat. Nos. 604,339; 817,039; 829,320; 896,646; 1,132,571; 1,686,678; 1,735,691; 1,383,665; 1,366,212; 4,178,661; 1,452,338; 1,055,503; 2,592,696; and 4,280,435.

Figure 16:
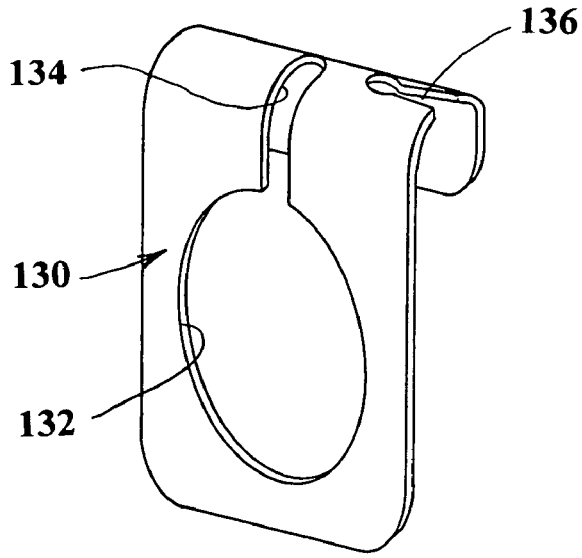
FIG. 16 is a perspective view of a tension-responsive self opening safety line tie.
Figure 17:
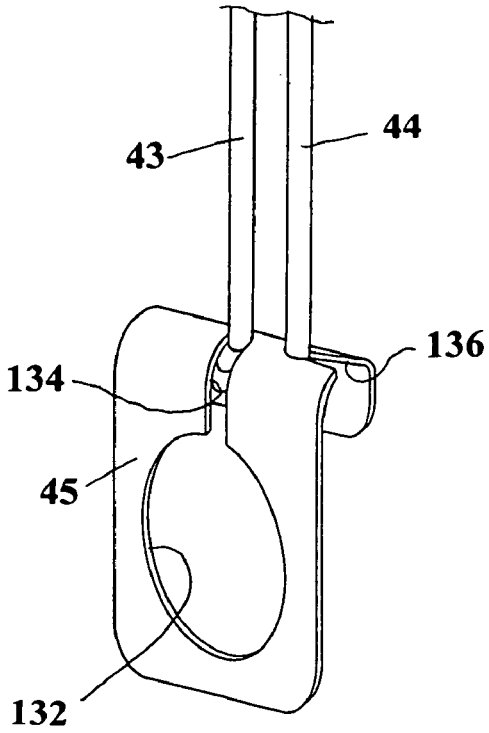
FIG. 17 is similar to FIG. 16, but showing the two free ends of the line shown FIG. 1 to be received and retained within the slots of the line tie.
Figure 18:
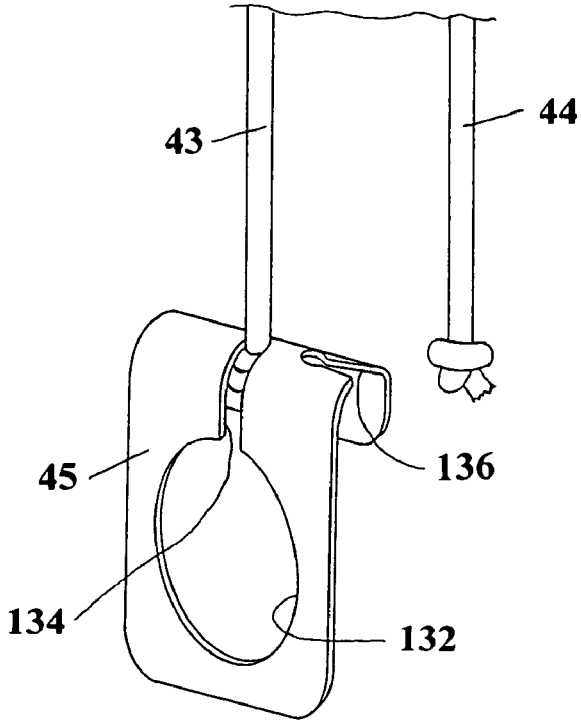
FIG. 18 is similar to FIG. 17, but showing one free end of the line removed from the lateral slot to open the resulting loop when safety so requires.

When it is desired to use a tie as suggested in FIG. 1, a suitable tie 130 is shown in FIGS. 16–18 for attaching the free ends 43, 44 of the line to each other in the proximity of the article. Preferably, the tie 130 is a tension responsive self opening safety line tie that can separate the free ends and open the loop initially formed by the tie. The tie 130 is shown as a generally flat plate opened along one edge to provide a generally key-hole-shaped slot 136 having two inclined lead-in edges leading to a generally circular opening having a diameter substantially equal to that of the line by means of a constricted neck portion less wide than such diameter. An opening 132 is provided in the plate for facilitating the support of an article, as with the ring 75 shown in FIG. 12, by allowing any article-supporting hook to be used. A generally uniform slot 134 extends from the opening 132 into the region of curvature. The second slot 136 is formed in the region of curvature and generally normal to the slot 134. Each free end of the line is formed with a knot received within a respective slot as shown.

The tension applied to the lower or free ends of the line urges the lower end 44 of the line portion 41 to be pulled out of the slot 136, thus providing the desired safe operation. Thus, the line portion 43 is substantially permanently fixed to the tie, while the lower end 44 of the line portion 41 to be pulled out of the slot 136, thus providing the desired safe operation. Thus, the line portion 43 is substantially permanently fixed to the tie, while the lower end 44 of the pulling line portion 41 is detachably secured to the tie. As suggested in FIG. 1, the lower end 44 is attached to the tie at 45 so that it does not dangle below the article and may be removed from the space occupied by the user or others. The shape and dimensions of the slot 136 are selected to retain the line except by application of manipulating forces of approximately 1–2 pounds. The benefit of the tie 130 is that if the loop shown in FIG. 1 is opened or broken there is no danger of the article falling and causing injury or damage by a dropping article since there is negligible tension in the pulling line portion 41 and the pulley assembly 15 maintains the cam 34 in the locked position.

In FIG. 12 a closed ring 75 is shown to be supported by the looped line. However, a closed ring cannot be easily used with assembled sheaves 114, 116, particularly if the closed rings are also intended to be interchangeably used with the hooks 110, 112 shown in FIG. 13, at different times or for different applications. The system may be needed to be used, for example, to suspend a bicycle with the hooks at one time or potted plants suspended by a closed ring at another time. Alternatively, the lifting device may be sold as a system that can be selectively used to provide one function or application or another. In that case, the sheaves 114, 116 must be selectively used with the hooks or with another supporting member to accommodate closed rings. Such other supporting member will be described in connection with FIGS. 23 and 24.

Figure 23:
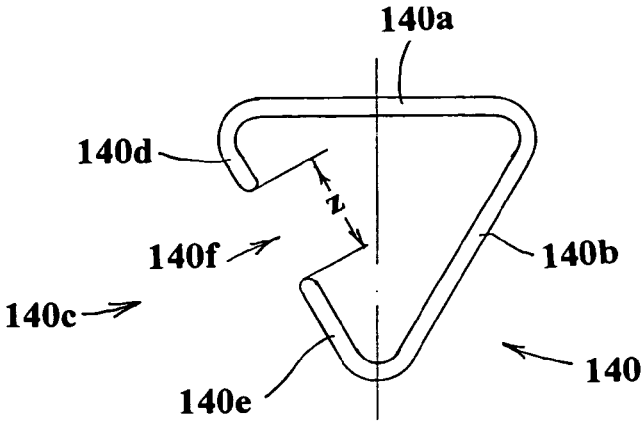
FIG. 23 is a front elevational view of one of two similar open segments that cooperate to form a closed ring similar to the ring shown suspended in FIG. 12.
Figure 24:
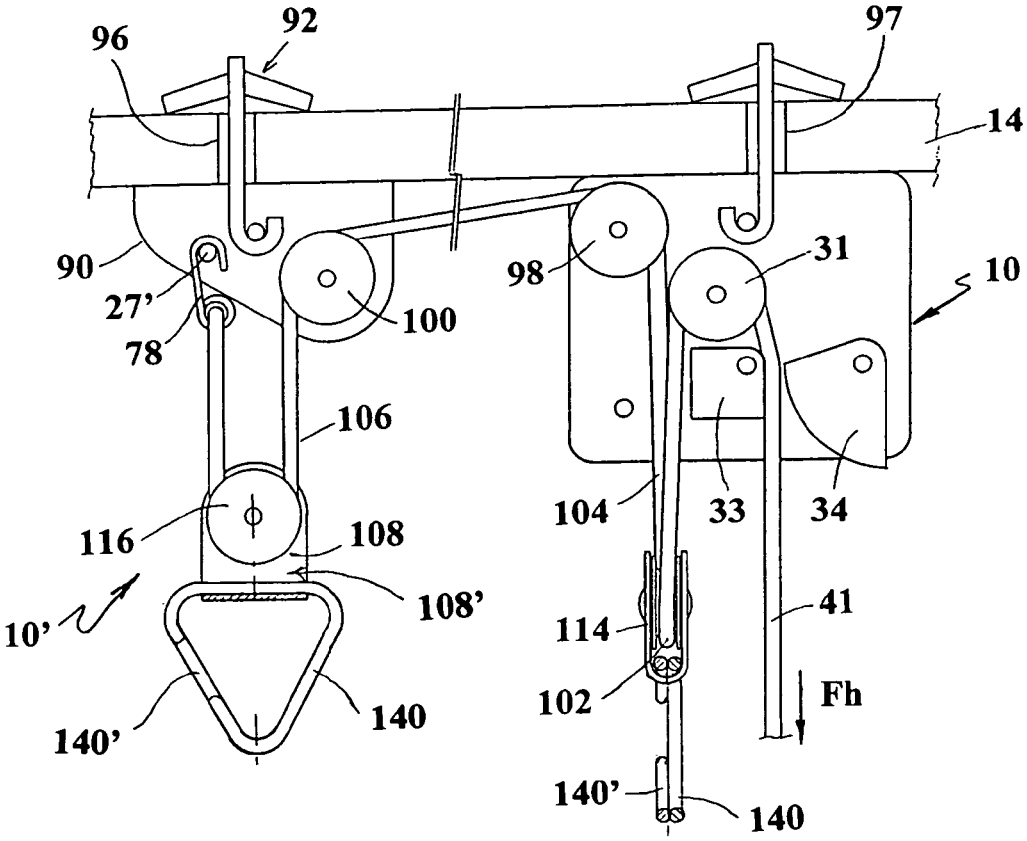
FIG. 24 is similar to FIG. 13 but showing each hook 110, 112 replaced by a pair of cooperating open segments of the type shown in FIG. 23 to form a closed loop system for safely suspending certain items, such as closed rings or wire loops of planters of hanging plants.

In FIG. 23 one of a pair of open segments 140 is shown which forms a partially open loop. More specifically, the open segment 140 is shown to have a generally triangular shape with two closed sides 140*a*, 140*b* and an open side 140*c* formed by two short portions 140*d*, 140*e* as shown to form a break or space 140*f* having a dimension z, the value of which is not critical as long as z is sufficiently large to accommodate wire rings having conventional sizes. Typically, z may be in the range 0.2–0.5 inches for most applications, although, as suggested, z may be smaller or larger as may be required by any given application. As suggested in FIG. 24, it will be clear that to serve the intended function, namely safely securing a closed ring, two open segments 140 must be used that must be aligned with each other but with the segments rotated or angularly offset by 120 or 240 degrees so that the open sides 140*c* are not co-extensive or aligned with each other. In this way one of the closed sides 140*a*, 140*b* of one open segment 140 is instrumental to close the open side 140*c* of the other associated or cooperating open segment, as shown in FIG. 24. Once the two open segments are arranged on the sheaves 114, 116 as shown in FIG. 24 a ring 150 can be passed first through the open break or space 140*f* of one of the open segments and then through the open break or space 140*f* of the other open segment. It will be clear that once supported as shown a downward force on the ring will draw the segments together and make it virtually impossible separate the segments from each other and thereby to remove the ring, particularly inadvertently. The open segments may assume other shapes or configurations. However, such open segments preferably have at least one straight open side so that it can be received and supported on the downwardly extending portion 108 shown in FIGS. 13 and 24. In this way, the same generally straight channel 108' can be used to support the transverse leg 110*a*, 112*a* of the hooks (FIG. 13) while similarly accommodating a straight side of an open segment 140. Of course, any other configurations of the sheave supports and engaging portions of the open segments and of the hooks may be used as long as once in place they are securely positioned and prevented from excessive movements which, as indicated, can result in an effective alignment of open breaks or spaces of two cooperating segments.

It should be clear that an open segment and a hook of the type shown can be alternatively be supported on the sheaves by aligning one free end of a segment portion 140*d*, 140*e* or of the hook, both of which are formed by a continuous rod, with a channel 108' (FIG. 13). The segment or hook is then manipulated to successively pass selected portions through the channel until the segment or hook is brought to a desired final position as shown. Such hook or segment can similarly be removed from the sheave by reversing the steps or manipulations. It should be clear that once two cooperating segments or a hook is in place and an object is suspended there from there is provided an extremely secure mechanical connection with the sheaves 114, 116.

With the previously described embodiments, as described, the cam relies on gravity to drop or pivot in a counter-clockwise direction, as viewed in the figures, to release the line 41 when it is pulled to create a tension therein. This occurs because the line 41 becomes taught and it is usually sufficient to clear the teeth of the cam 34. Once this occurs, the weight of the cam, with its centre of gravity to the left of the pin 22 as viewed in FIG. 25, causes the cam to rotate in the direction 34*h* thereby further clearing the line 41. However, if the cam 34 has pivoted sufficiently during the line locking stage so that the wider part 34*f* of the cam becomes jammed against the line then simply pulling of the line slightly may not be sufficient to release the cam. To obviate or minimize this possibility there may be provided a biasing means that normally urges the cam to rotate in a counter-clockwise direction 34*h* to assist the cam in returning to its normal position shown in FIG. 25 in which it does not contact the line 41. The specific biasing means is not critical and any suitable biasing element or device may be used for this purpose. By way of example, a biasing spring in shown in FIG. 25 in the form of a butterfly spring 150 having a helical cylindrical portion 150*a* mounted on the pin or post 22 with one extension leg 150*b* abutting against the housing 21 while the other extension leg 150*c* engages the cam 34 and any suitable or known manner. The extension legs are slightly brought together so that the legs are biased to move apart in the leg that engages the cam to move and a counter-clockwise direction, as viewed in FIG. 25, when the other leg is fixed in position.

Figure 26:
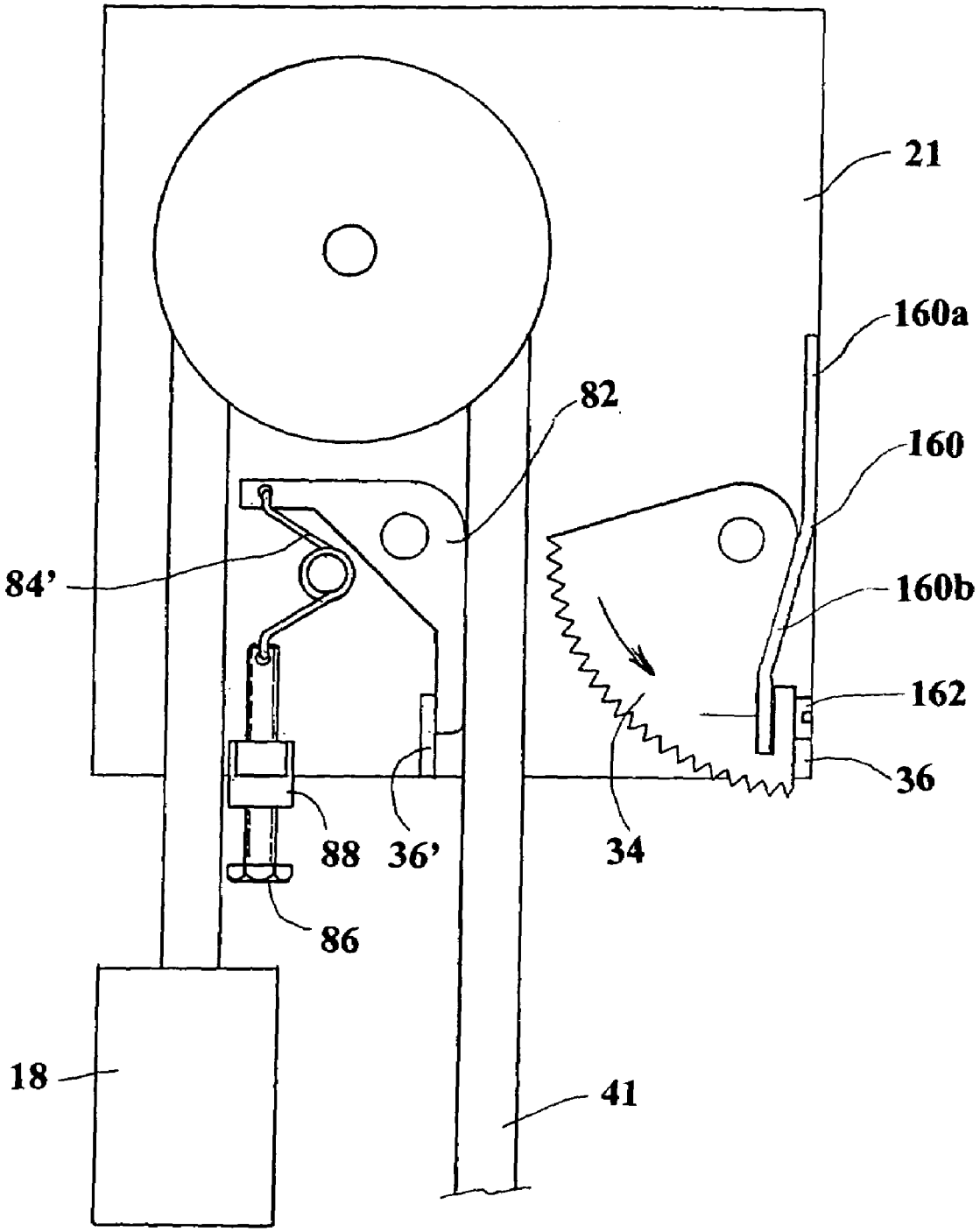
FIG. 26 is similar to FIG. 25, but illustrating a cam employing a flat or leaf spring instead of a butterfly spring.

In FIG. 26 and alternative biasing means is used, and the form of a leaf spring 160, having one end 160*a* fixed on the housing 21 while the other end 160*b* can be variably moved from the housing by a bolt 162 threadedly mounted on the cam 34. Turning of the bolt flexes the leaf spring more or less. When the line 41 is pulled tight as shown the leaf spring reverts to the position shown by causing the cam to rotate in a counter-clockwise direction.

Figure 25:
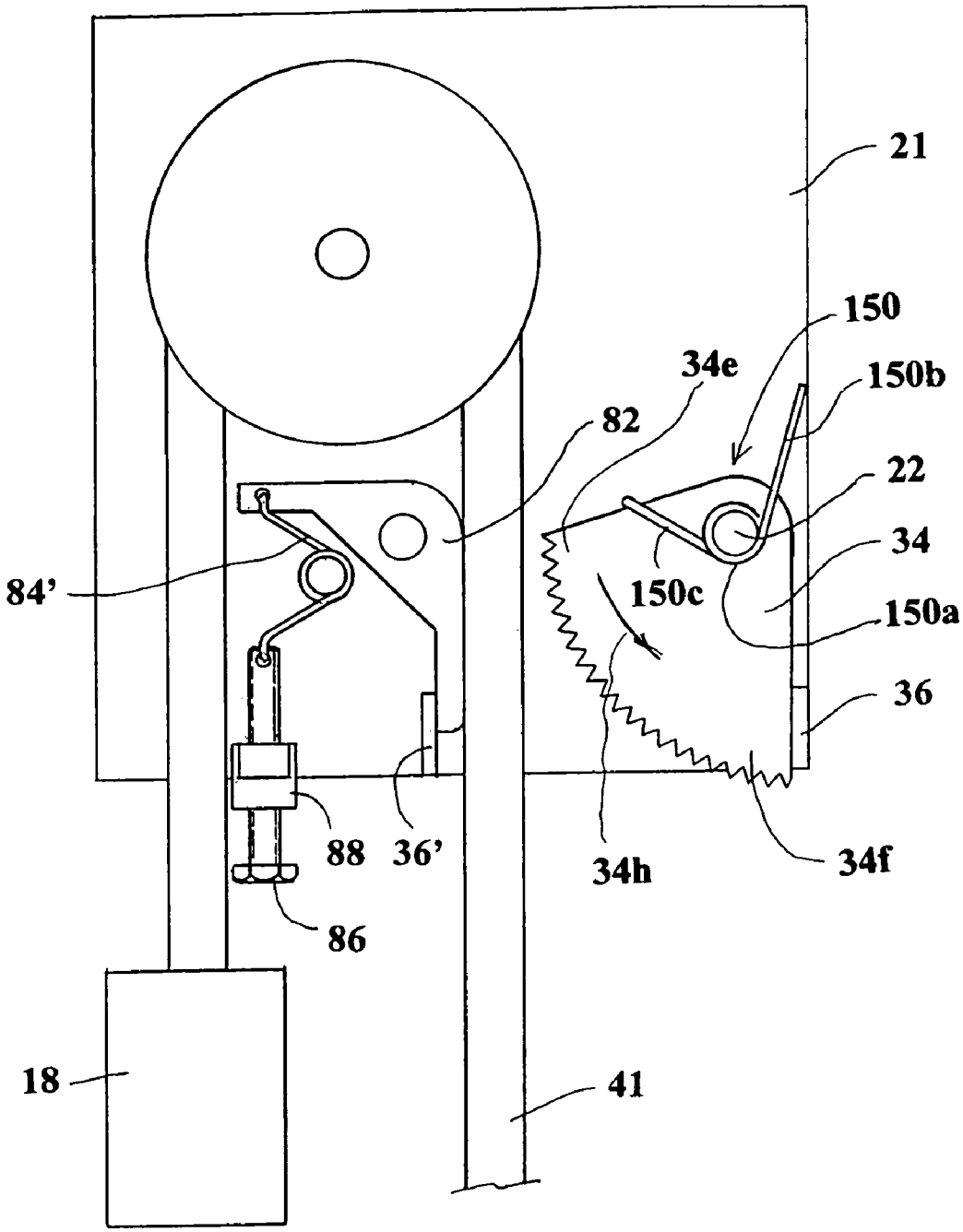
FIG. 25 is a side elevational view of a failsafe device in accordance with another embodiment of the inventions, similar to FIG. 22, in which a cam employs a butterfly spring to urge it to return it to a normal, line releasing position.
Figure 27:
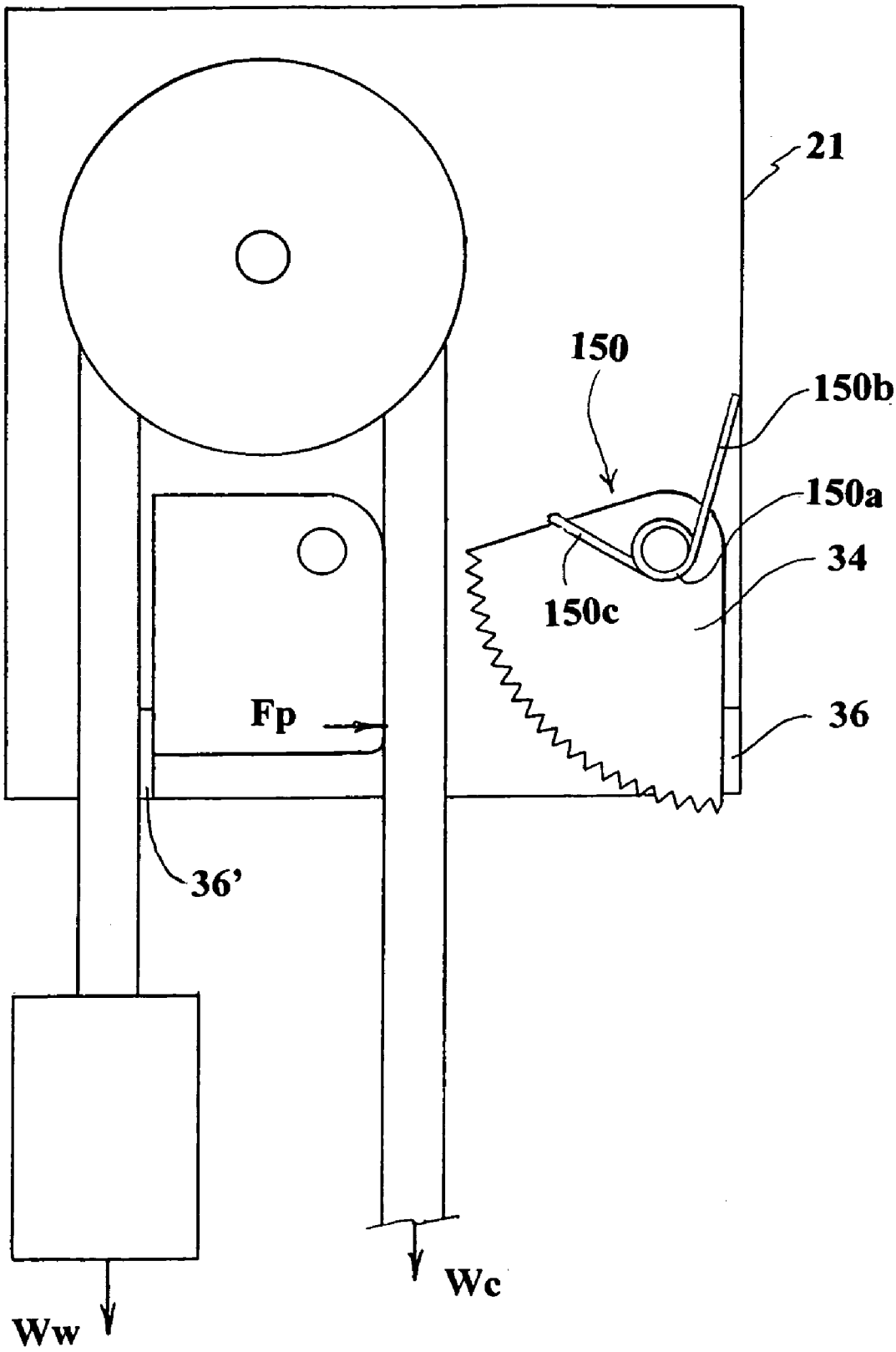
FIG. 27 is similar to FIG. 3, but illustrating a cam employing a butterfly spring as in FIG. 25.
Figure 28:
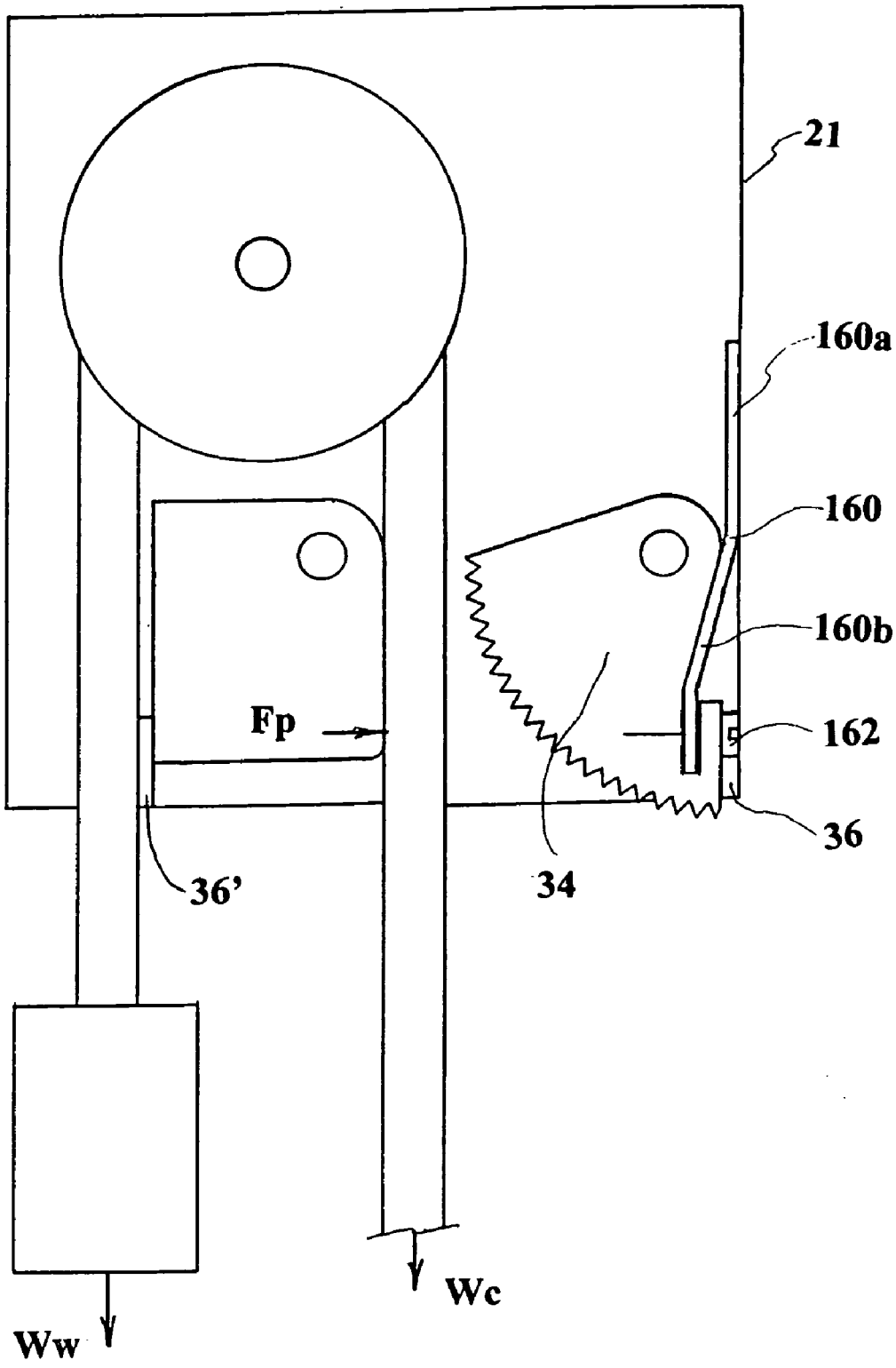
FIG. 28 is similar to FIG. 3, but illustrating a cam employing a flat or leaf spring Instead of a butterfly spring.
Figure 29:
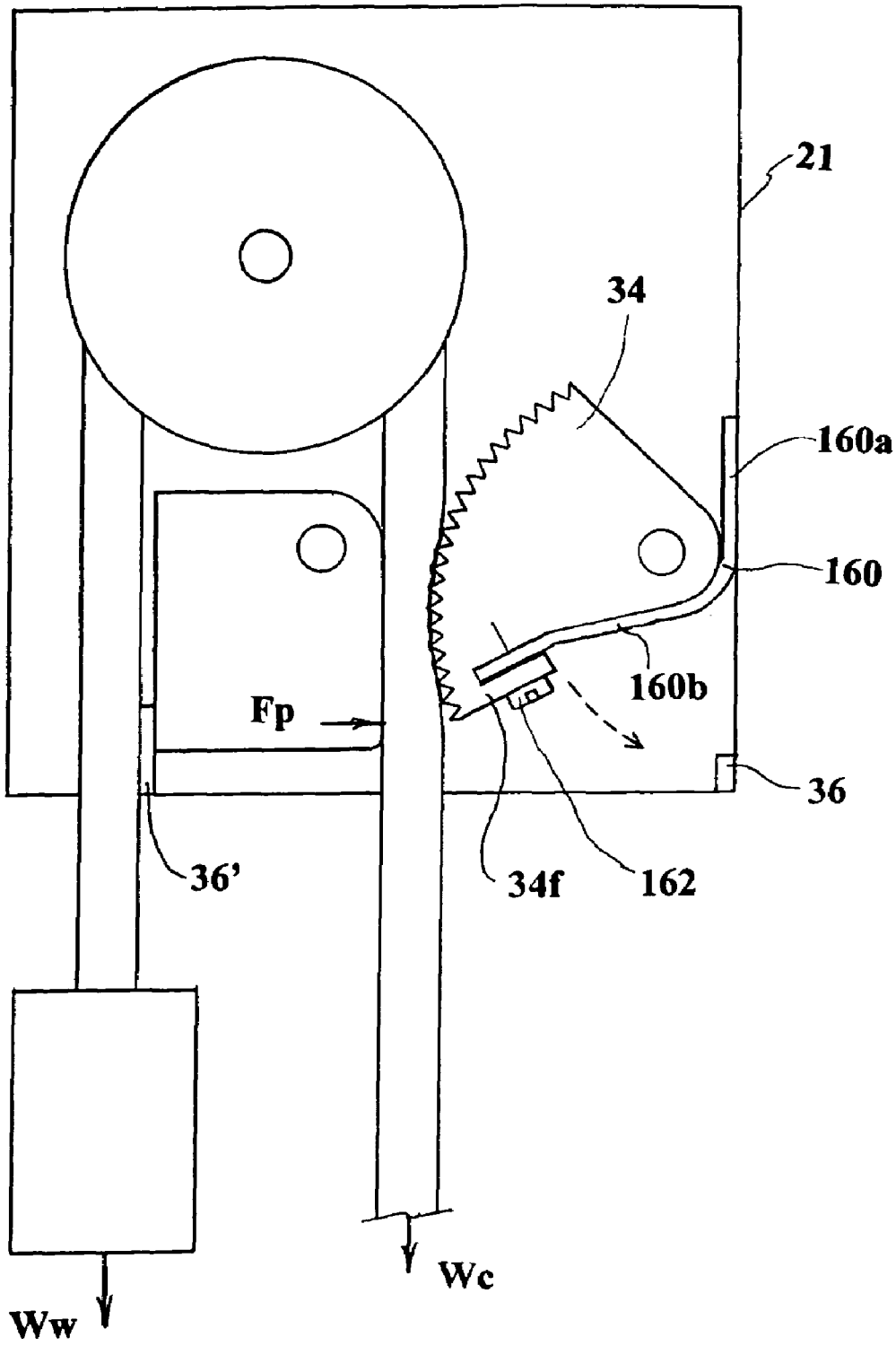
FIG. 29 is similar to FIG. 28, illustrating the position of the cam in its line retaining position with the flat or leaf spring in its deflected condition tending to urge the cam towards a line releasing condition.

FIG. 27 shows a butterfly spring similar to the one shown in FIG. 25, while a FIG. 28 shows a leaf spring similar to the one used in FIG. 26, and the different embodiments of the invention described above. In FIG. 29, the leaf spring 160 is shown in a flex positioned when the cam has rotated in a clockwise direction to lock or seize the line when the cam 34 rotates in a clockwise direction. It should be clear that as soon as the line portion contacting the cam 34 is pulled to offset any lateral forces $F_p$, thereby reducing the frictional forces with the cam 34, the restoring forces in the leaf spring 160 will urge the cam 34 to disengage the line and return to its steady-state or rest position shown in FIG. 28. The use of the such a biasing means renters the device more reliable and easy-to-use.

Figure 30:
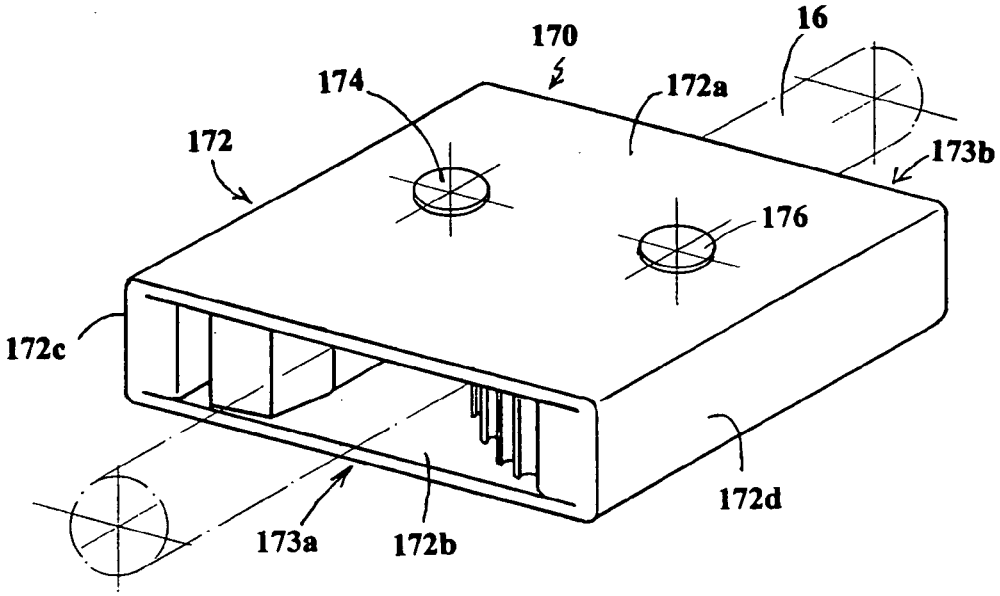
FIG. 30 is a perspective view of a cleat in accordance with the present invention, illustrating in Phantom outline a cord, rope or line that can be controlled with the cleat.
Figure 31:
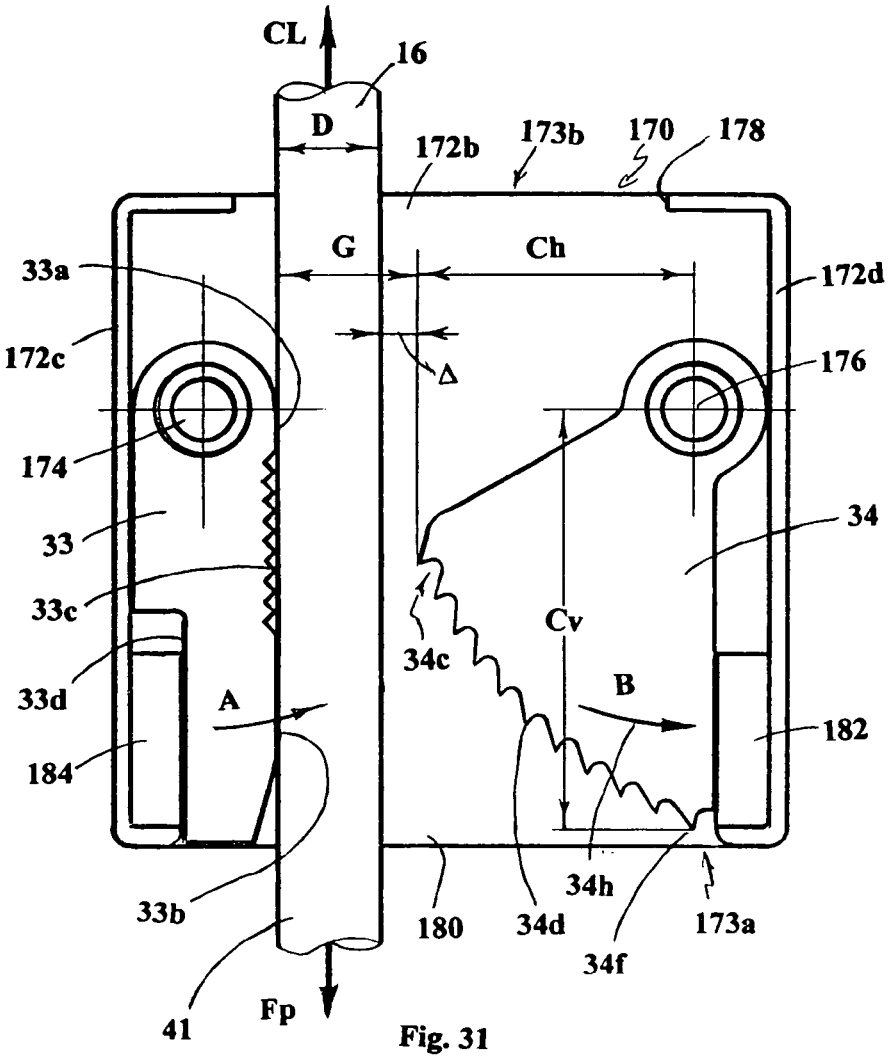
FIG. 31 is an enlarged top plan view of the cleat shown in FIG. 30, with the top wall or the frame of the housing removed.
Figure 32:
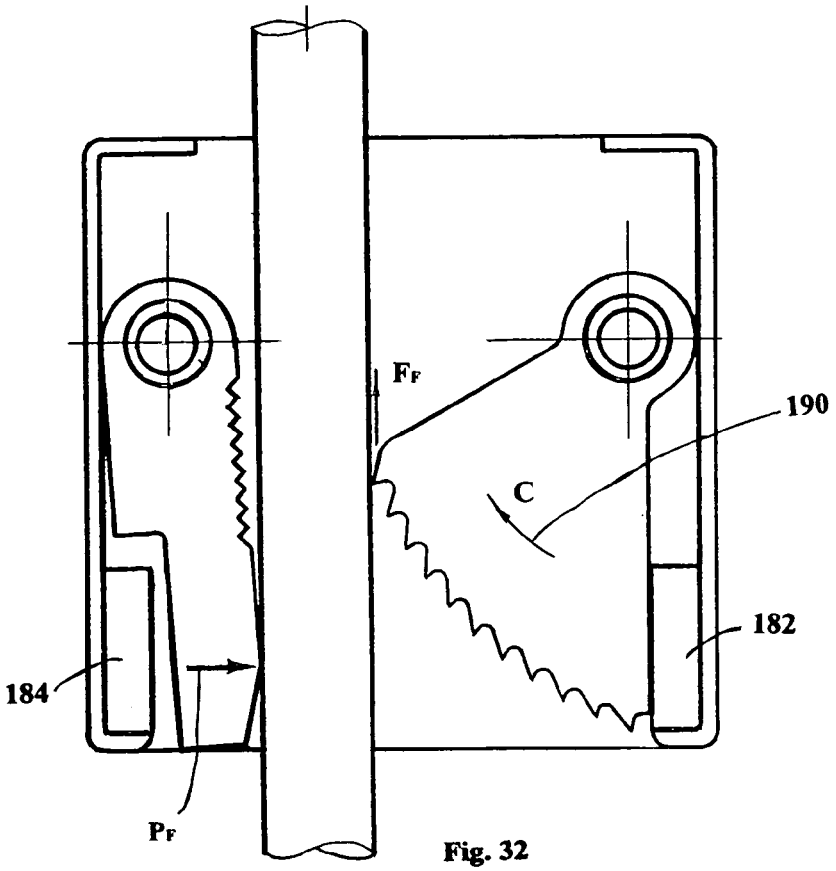
FIG. 32 is similar to FIG. 31, showing them a relative movement of the members of the cleat as they move from the unlocking to the locking positions.

In FIG. 30 a cleat is generally designated by the reference 170. The cleat 170 is formed of a frame or housing 172 that has a top wall 172*a*, a bottom wall 172*b* spaced from the top wall, and sidewalls 172*c*, 172*d*. Referring also to FIG. 31, the frame or housing 172 has a proximate side 173*a* and a remote side 173*b* on substantially opposite sides of the frame and formed there with a passageway, extending between the proximate the remote sides, for receiving a line or rope 16 and a generally defining a cleat center line CL along which the line can move along a first line releasing direction from the proximate to the remote sides and a line pulling direction from the remote to the proximate sides.

Any suitable means may be used for attaching the frame 172 to a support surface on a boat, ladder or the like. In the disclosed embodiments, and the frames of the cleats can be attached by suitable fasteners such as screws or bolts designated by the reference numerals 174, 176 and that extend through suitable openings or holes in the top and bottom walls of the housing or frame as well as a through the pivoted components 33, 34 that all are also mounted to be pivoted about the elements 174, 176 that serve as pivot pins. The pusher 33 in the cam 34 may be pivotally mounted on hollow pins that form openings, the top and bottom walls of the housing or frame being provided, in such case, with holes aligned with the openings. Any suitable fasteners may, as suggested, be used that extend through at least one set of associated openings and frame holes to secure the frame to a support surface.

As will be noted, the cam 34 is mounted on the frame on one side of the passageway, the cam being movable between a line releasing position and a line locking position. The cam 34 and it's a general operations has been previously described. Also previously described is the general operation of the pusher 33 which is mounted on the frame on an opposite side of the passageway in relation to the cam 34 for selectively applying a force on the line in the direction of the cam for urging the line across a clearance gap into contact with the cam only when the tension in the line on the proximate side 173*a* is less relative to the tension in the line at the remote side 173*b*. As the previously described continued contact between the line and the cam rotates the cam in a clockwise direction beyond the gap while the cam moves from a releasing to a locking position until a tension is applied by the user to the line on the proximate side that at least equals the tension at the remote side.

A feature of the cleat is of the provision of a cam biasing means that normally tends to urge the cam to disengage from the line. Similarly, a pusher biasing means is preferably provided that normally tends to move the line across the gap into contact with the cam while permitting the line to return to the passageway out of contact with the cam went sufficient tension is applied by the user off the cleat center line to create a force component to offset the pushing force created by the pusher biasing means. As will become evident, and these biasing means promote unlocking of the line and allow the line to move and the line releasing direction. As suggested, the biasing means acting on the pusher 33 and/or the cam 34 may be the form of a spring acting between the frame and the associated pivoted member. However, and the presently preferred embodiments magnets that provide forces of attraction and repulsion are preferred for their effectiveness, reliability and simplicity.

Figure 35:
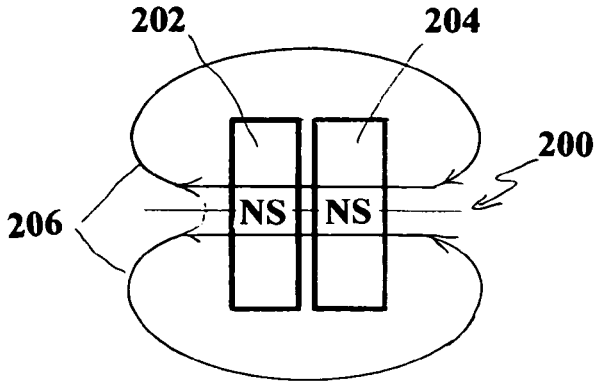
FIG. 35 is a schematic diagram of two magnets arranged with their magnetic poles in a manner to create magnetic attraction forces between the magnets.
Figure 37:
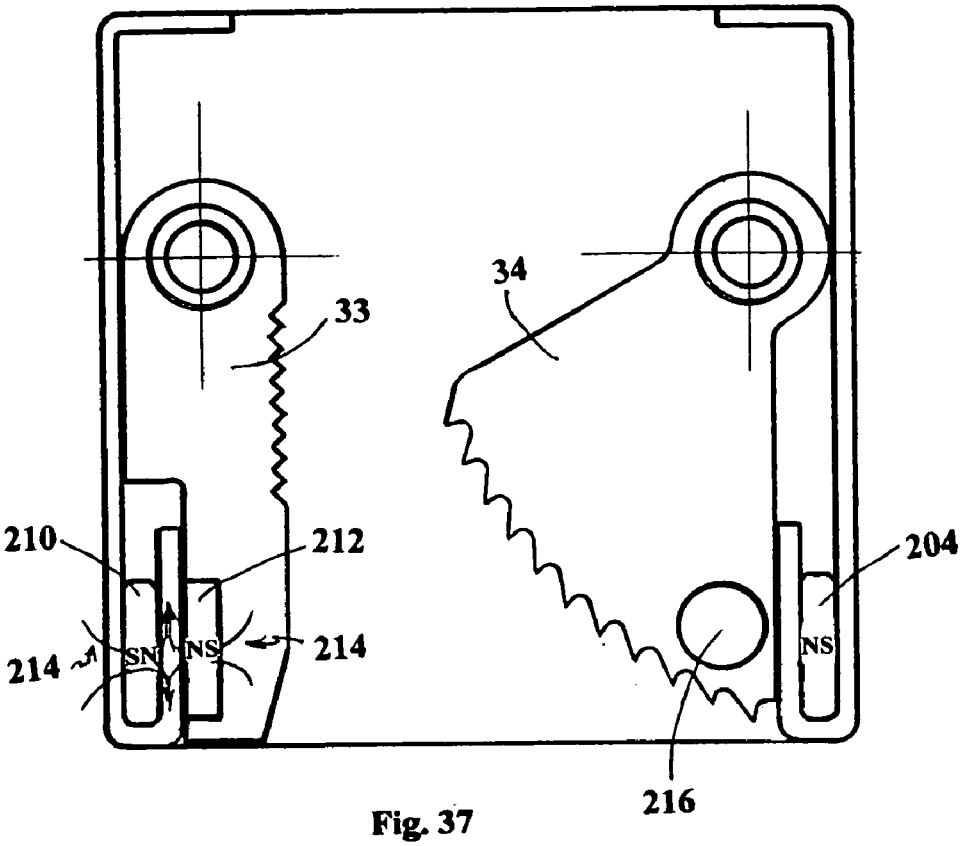
FIG. 37 is similar to FIG. 31 but showing an alternate embodiment in which a soft iron disk is embedded in the cam that is attracted to the magnet.
Figure 38:
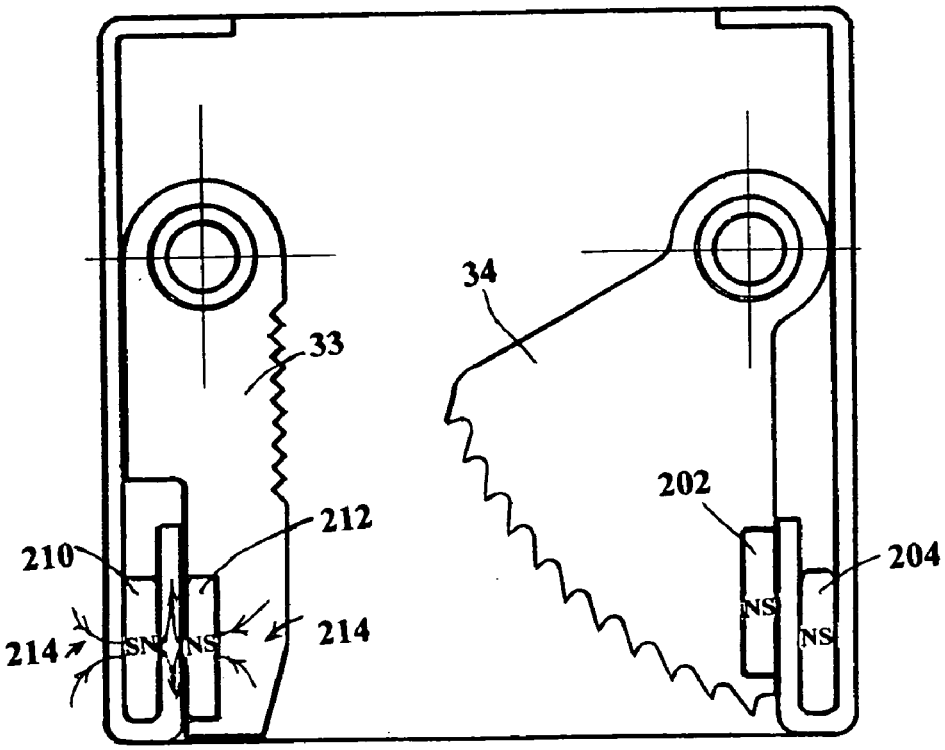
FIG. 38 is similar to FIGS. 31 and 37 but showing a still further embodiment in which a magnets is mounted on the cam and arranged it to be attracted to a proximate magnet mounted on the frame.

Referring to FIG. 31, the pusher 33 is provided with a cut out that, recess or cavity 33*d* to accommodate a magnetic element 184 that creates a repulsing magnetic force on the pusher. Similarly, a magnetic element 182 is provided proximity to the cam 34 for creating attraction magnetic forces acting on the cam. Where the cam 34 is formed of a magnet to a magnetizable metal, such as a soft steel, the magnetic element 182 may be a magnet arranged with either polarity in proximity to the cam. As suggested in FIG. 37, we're the cam 34 is not formed of a magnetic material but maybe formed of a plastic or the like, a suitable element 216 formed of a magnetic material may be imbedded in the cam 34 in proximity to the permanent magnet 204 fixed on the frame. Such element 216 may be made of a soft iron. Referring to FIG. 38, it will be noted that a permanent magnet 202 may be mounted on the cam 34. In such a case, referring to FIG. 35, the magnets 202, 204 must be arranged with that he polarities shown so that the magnetic fields that are formed create forces of attraction that seek to reduce or minimize the distance between the magnets and tend to pivot of the cam 34 and a counterclockwise direction.

Figure 36:
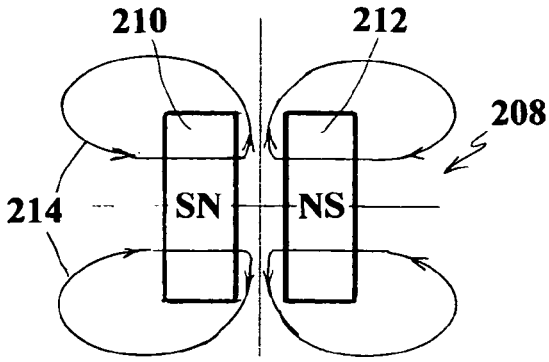
FIG. 36 is a schematic diagram of two magnets arranged to within their magnetic poles in a manner to create magnetic repulsion forces between the magnets.

Referring to FIGS. 36 and 38, two magnets 210, 212 may also be used to provide the desired biasing forces to the pusher 33. Here at, and the permanent magnet 210 is fixed on the housing or frame while the magnet 212 is mounted on the pusher for movements therewith. However, for the pusher to be biased towards the passageway and the line or rope the two magnets must be so arranged in proximity to each other and that in their respective poles facing each other are of the same polarity so that the magnetic lines of force 214 create repulsion forces that tend to pivot the pusher in a counterclockwise direction.

Figure 34:
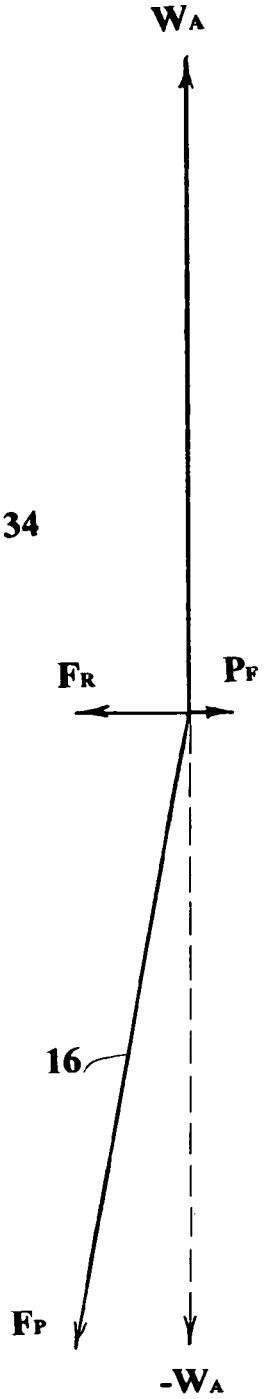
FIG. 34 is a force diagram illustrating in the manner in which a suitable force can be applied it to a cord or line to create a component that act against an internal element of the cleat to thereby unlock or release the cam acting on a cord or line.

It should be evident that the magnetic force acting on the pusher 33 can be adjusted to provide lower or higher biasing forces. However, generally, the biasing forces are such that the pusher applies a transverse force generally normal or perpendicular to the passageway or cleat centreline or axis that is significantly smaller than the tensions applied on the line or rope along its longitudinal directions. Since such transverse force always seeks to urge the line or rope against the cam in the cleat will automatically and almost instantaneously arrest or lock the line or rope as soon as of the tension of the pulling or the proximate side is lowered or reduced to zero. In order to unlock or release the line or rope it will be clear, referring to FIG. 34, that the transverse force applied by the pusher must be overcome and compensated before the pusher can return to its retracted position shown, for example, in FIG. 38. To achieve a compensating force of $F_R$ equal to the pushing force $P_F$ the cord or line 16 needs to have a tension $F_P$ applied to it off the centreline by an angle a that may be as low as one degree but more typically in the range of 4–6 degrees.

Figure 39:
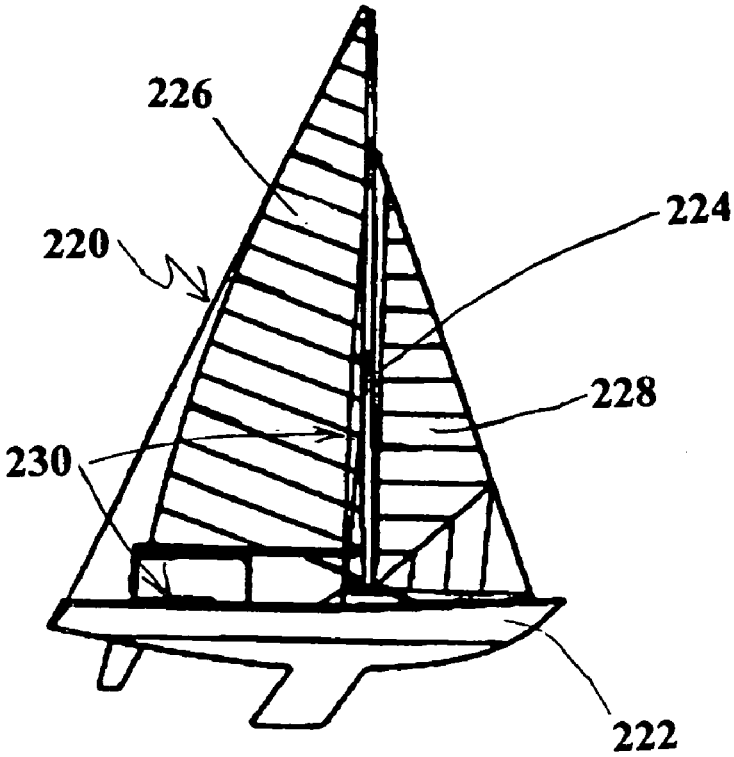
FIG. 39 is an illustration of a sailboat and examples of position where cleats in accordance with the invention he can be used.
Figure 40:
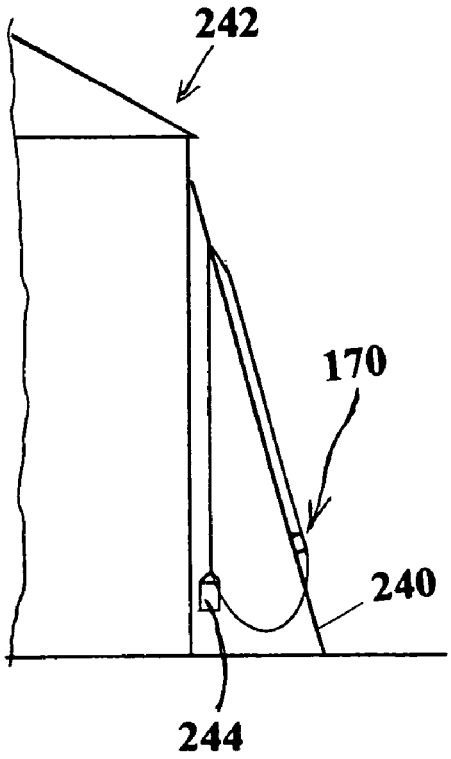

Referring to FIGS. 39 and 40, it will be evident that the cleat of the present intention may have numerous applications. A sailing ship or yacht 220 having a hull 222 and mast 224 and sails 226,228 can use the new cleats and multiple locations for regulating the lines or ropes attached to such members. A cleat 170 may also be attached to a ladder 240 used in conjunction with a housing structure 242 to raise and lower various objects 244, such as tools, paint and the like. For such purpose, the line or rope 16 may be made in the form of a loop as a shown in FIG. 40.

It will be clear and that the frame 172 may be formed of metal or may be made of a nonmetallic material. However, if magnets are used for providing biasing forces the housing or frame is preferably made of nonmetallic materials, such as plastics, or none magnetizable metals in such as aluminum or certain alloys of stainless steel.

Figure 33:
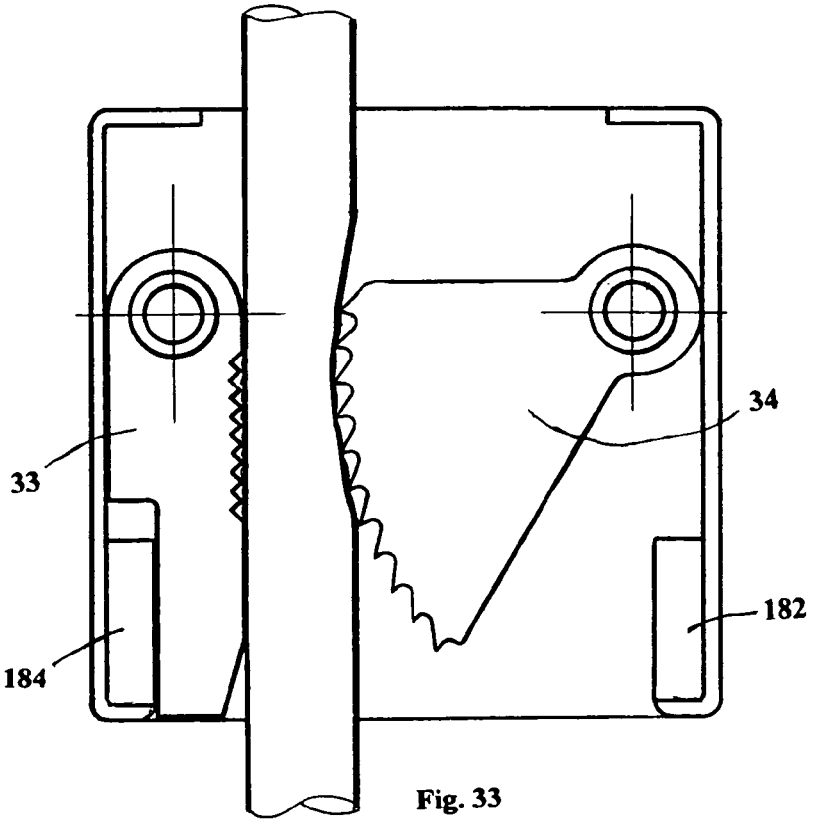
FIG. 33 is similar to FIGS. 31 and 32, but showing in the internal members of the cleat in positions in which the line is locked or arrested from movement.

To enhance the operation of the cleat, the pusher 33 is preferably provided, on the side facing the passageway and the cord or line 16, with upper and lower smooth surfaces 33*a*, 33*b*, with a serrated or toothed mid-region 33*c* which, as best shown in FIG. 33, engages the line one is forced by the cam 34 in the locking position. However, when the cam 34 is not in its locking position, as shown a FIG. 31, the line or rope does not engage the serrations on the pusher on the pusher but slides against the smooth surfaces 33*a*, 33*b*.

Figure 41A:
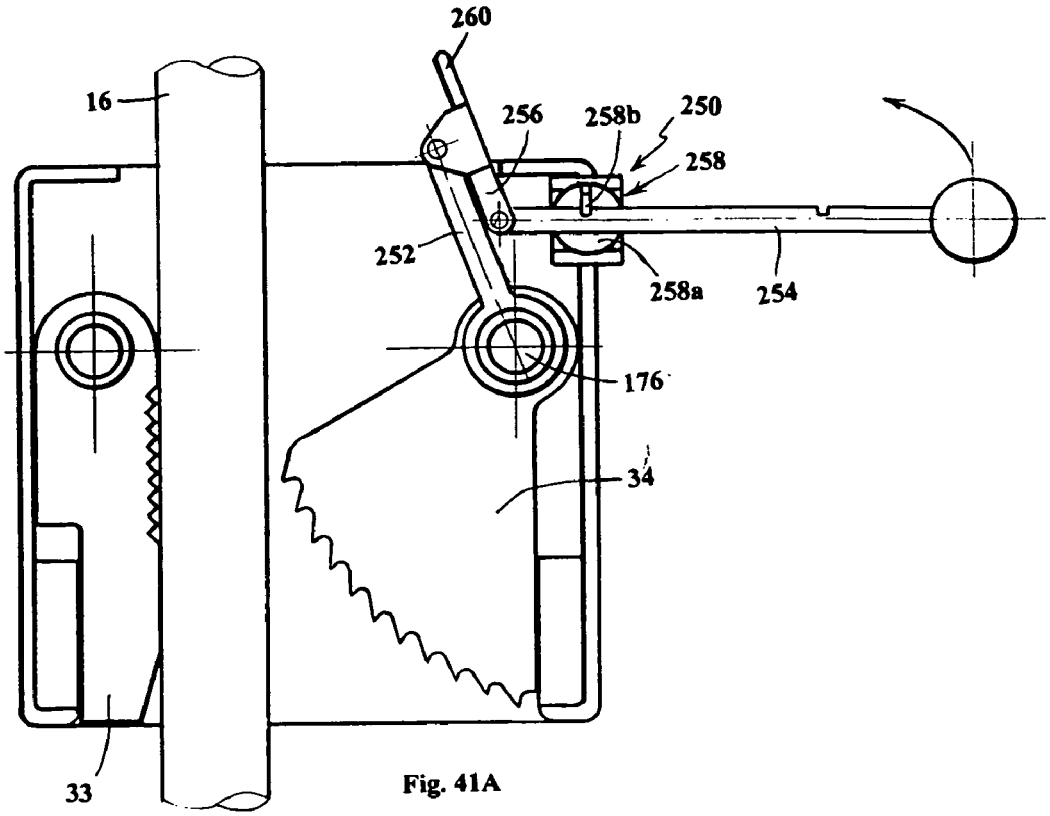
FIGS. 41A and 41B are similar to FIGS. 31, 37 and 38 but illustrate a cam disabling mechanism that can be selectively positioned between the line or cord and the cam to prevent the cord or line from the being arrested or locked.
Figure 41B:
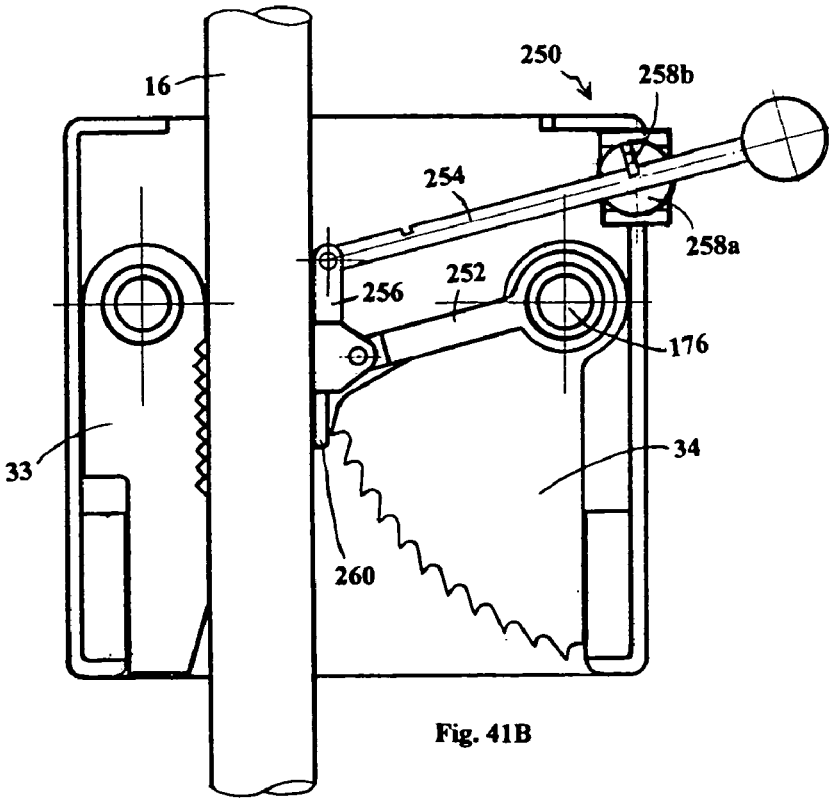

Referring to FIGS. 41A, 41B, when it is desired to disable the cam 34 so that it cannot arrest or lock the line or cord, any suitable disabling mechanism may be used. By way of example, one such mechanism is designated by the numeral 250, which includes a lever arm 252 mounted for independent pivoting action about the pin 176 for pivoting movements concentrically about the same axis as for the cam 34. The end of the lever arm 252 is connected to a manually operated handle 254 by means of an intermediate link 256 as shown. The link 256 has one end pivoted to the handle 254 while the other end 260 forms a free end or extension. The handle 254 is slidably mounted through a slot in a ball joint 258 that can pivot about ball 258*a*. Additionally, the handle can slide linearly through the ball 258*a* and fixed in a desired position by means of a pin 258*b*. In FIG. 41A, the extension 260 is positioned to avoid any contact with the line 16 or the cam 34 so that it is in its enabling position in which the cam 34 is enabled and it can function as described to lock the line or rope. However, referring to FIG. 41B, by sliding the handle inwardly into the housing or frame and rotating the handle in a counter-clockwise direction about the ball 258*a*, the linkage arrangement moves the extension 260 to a position shown in which it is interposed between the line or rope and the cam 34 so that the cam and its teeth or serrations cannot engage the line or rope or arrest or lock the same as previously described. In this way, by a simple movement of the handle 254 the cleat can be disabled and the line or rope can be easily moved in either direction along the passageway.

Figure 42:
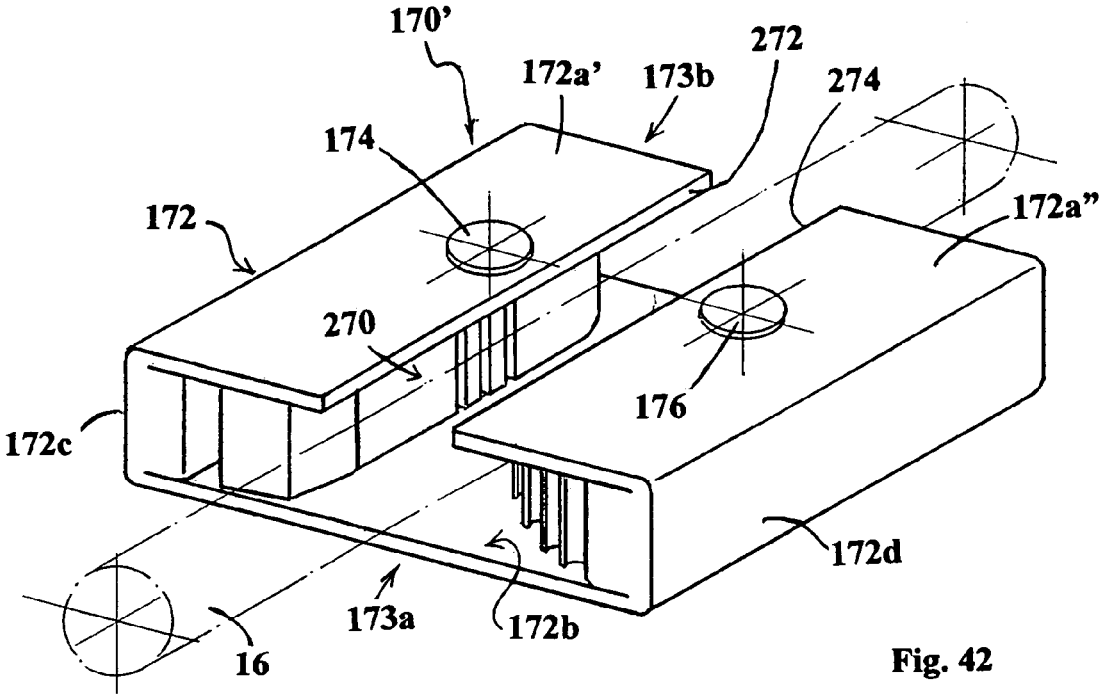
FIG. 42 is similar to FIG. 30 but showing a further embodiment of the fail-safe device in the form of a cleat for use, for example, with lines used on sailing vessels, provided with a slot in one of the walls of the device for quick-release and removal of a line from the device.

There are instances when a line, being secured, needs to be released very rapidly. One example is when a line attached to a sail of a sailing vessel needs to be released almost instantaneously when there is a sudden shift in the winds impinging on the sails. Referring to FIG. 42, an alternative embodiment 170' is shown which may be virtually identical to the embodiment 170 shown in FIG. 30, may have the same operative elements and function in the same way except that one of the two walls 172*a*, 172*b* is provided with a slot 270 generally aligned with the axis CL of the line 16 to form wall portions 172*a*' and 172*a*" and having a width generally corresponding to the width or diameter of the line 16 so that the line can move into and out of the device through the slot. Thus, the edges 272 and 274 of the slot 270 are spaced sufficiently apart to allow the line 16 to pass through the slot without interference or resistance. It will be appreciated that when the line needs to be released very rapidly, lifting the line so that it is moved through the slot 270 beyond the plane of the elements 33, 34 removes any restrictions on the line and it can be released at any speed. When the line needs to be secured again it can be inserted through the slot 270 to be positioned between the elements 33, 34 and the line can be controlled and arrested as described previously.

Figure 43:
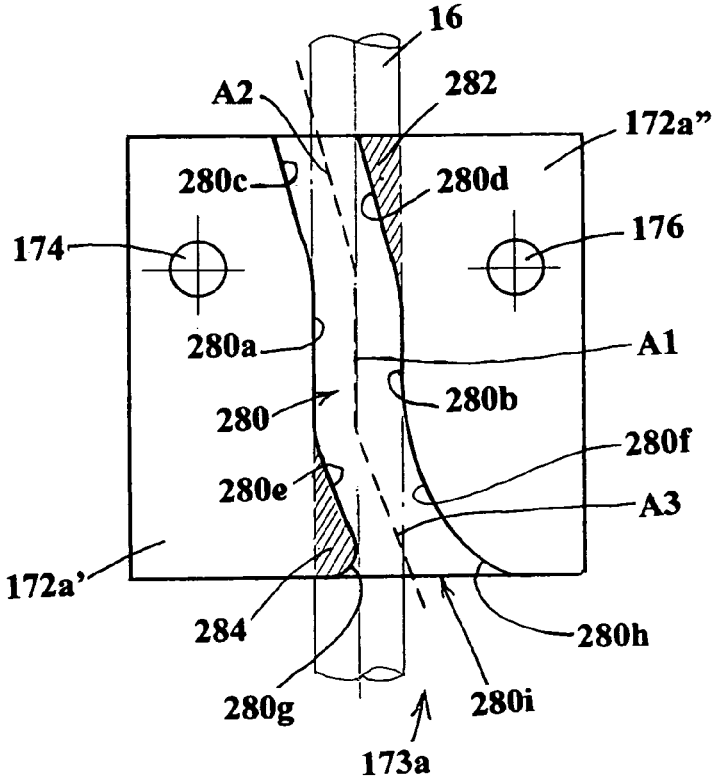
FIG. 43 is a top plan view of a modified version of the device shown in FIG. 42 in which the slot is not straight but has at least one offset portion.

In FIG. 43, a variation of the embodiment shown in FIG. 42 includes a nonlinear slot for preventing inadvertent escape of the line 16 through the slot. The modified slot includes, in the example, an aligned slot portion that generally corresponds to the slot 270 in FIG. 42 defining an axis A1 aligned with the axis or center line CL of the line 16. The edge portions 280*a*, 280*b*, then, correspond to the edges 272, 274 of the linear slot 270. However, at the remote end 173*b* the slot deviates or is offset to the left, as viewed in the Figure, to define an axis A2 and edges 280*c*, 280*d*. Similarly, at the proximate end 173*a* the slot deviates or is offset to the right, as viewed in the Figure, to define an axis A3 and edges 280*e*, 280*f*. Opposing edges remain spaced substantially the same distance, as in FIG. 42, to allow easy and rapid removal of the line without resistance. It will be noted that when the slot is modified in the manner shown, there are created blocking portions 282, at the remote end, and 284 at the proximate end that are superimposed on the line to thereby block inadvertent movement of the line out of the slot when the line is tight or straight as shown. However, when the line 16 is moved, at the proximate end 173*a*, to the right into general alignment with the axis A3 that portion of the line becomes aligned with the edges 280*e*, 280*f* and the line can be removed by lifting it out of the slot at the proximate end. The line will then easily pass through the remaining portions of the slot by being guided by the edges 280*a*–280*d* until the line is fully withdrawn and moved beyond the blocking portions 282, 284, at which time the line can be released without the influence of the device. To facilitate the initial removal of the line at the proximate end, as described, the slot may be provided with curved portions 280*g*, 280*h* that create an enlarged and tapered entry passageway 280*i* that simplifies initial guidance of the line 16 into the slot. The embodiment shown in FIG. 43 has the advantages of the embodiment shown in FIG. 42 except that is provides an extra measure of safety and reliability so the a line may be rapidly released but only when desired and not inadvertently or accidentally.

Referring to FIG. 44, a schematic view is shown that exemplifies some of the previously described embodiments, such as the cleats shown in FIGS. 30–33, 37 38 and 41A–43. The frame 172 is mounted on the support or mounting surface MS. In these embodiments the same mounting members or fasteners in the form of bolts 174, 176 used to pivotally support the pusher 33 and cam 34 were also the same members used to attach the cleat frame or housing to a support surface MS. The cam 34 and the cam portion that engages the line when the line is arrested, locked or stopped is generally or effectively positioned at a point 294 between the two opposite remote and proximate sides generally along the axis of the cleat and along the direction of movement of the line as it passes through the cleat. Also, the line engagement point with the cam is spaced from the support surface MS a predetermined distance 298. It will be evident that a sudden or instantaneous locking action by the cam on the line will create an upward force FC1, as viewed in FIG. 44, by the line on the cam and, therefore, as well on the cleat housing or frame. Such upward force FC1 created by the line is transmitted to the fasteners or bolts 174, 176 and an equal opposing, downward force FC2 is created by the mounting surface to prevent the cleat from moving upwardly. However, the creation of the counter-force FC2 creates a force couple that is a function of the distance 298. The greater the force couple forces FC1, FC2 and the greater the distance 298 the greater the force couple, which is a product of these two parameters. The force couple is represented by the numeral 300 which also indicates the tendency of the frame or housing 172 to rotate in a counter-clockwise direction, tending to separate or lift at least the proximate side of the frame or housing away from the mounting surface MS. This result is undesirable as it tends to forcefully rip off or remove the unit from the mounting surface.

With the designs previously described above the force couple is compensated by a counter-moment the magnitude of which is a function of the height K1 of the frame or housing above the bolts or fasteners 174, 176 which created a counter-force CF acting on the upper edge E of the housing or frame. Because the magnitude of the force CF is inversely proportional to the distance K1 one option for reducing such force is to enlarge the height of the housing or frame, as suggested by the phantom outline with edge E' to provide a new distance K2>K1. However, the enlargement of the housing solely to compensate for the force couple 300 is not always practical for a number of reasons including the difficulty of using the larger cleat housings on small mounting surfaces.

Referring to FIG. 45, a modified cleat design is shown, in a frontal view with the top cover or wall removed. The cleat is shown in a line locking position, in which the cam 34 engages the line 16, while the pusher 33 is forced to its retracted position against the biasing action of the repelling magnets 210, 212. As suggested above, the effective pressure point at which the cam acts on the line is referenced at 294. However, with the new design the pusher 33 and the cam 34 are mounted on pins or rivets mounted only on the rear or back wall (as viewed in FIG. 45) and these are not connected or fastened to the mounting surface MS. Instead, the frame or housing is attached to the mounting surface by means of separate fasteners 290,292. While the pins or pivots 174, 176 are proximate to the remote side of the frame or housing, at a point between the remote side and the line contact or engagement point 294, the fasteners 290,292 are positioned between such contact point 294, at a distance 296, and the lower side or edge of the housing or frame. By lowering the attachment points closer to the proximate side of the frame or housing, the effective distance for the counter-moment is increased to K3 (FIG. 46), greater than K1 or even K2, without the need to increase the height of the frame or housing. Thus, the cleat can now better handle the resulting force couple without the need to enlarge or even reduce the size of the cleat housing.

Still referring to FIG. 45, the line 16 is shown angularly deflected both at the proximate and remote sides of the cleat at an angle $\alpha$. In both positions the deflection is in a direction towards the left, as viewed in the Figure, towards the pusher 33 and away from the cam 34. Preferably, such deflection is provided, as suggested, to avoid inadvertent contact of the line with the can 34 when the user applies a tension on the line at the proximate side since this might prematurely engage the cam. In essence, since the magnets 210, 212 repulse each other and tend to bias the pusher towards the right, as viewed in FIG. 45, to urge the line against the cam, the angle $\alpha$ is selected to produce, when a tension is applied to the line, a force component towards the left that is at least equal to the biasing force produced by the magnets 210, 212. This insures that the line remains in contact with the pusher and out of contact with the cam. Of course, when the line is released and the tension removed from the line the compensating component of the force towards the left is eliminated and the biasing force of the magnets is permitted to push or move the line into contact with the cam.

The angular deflection $\alpha$ can be achieved in any conventional way. However, in the illustrated embodiment, such deflection is achieved by the use of eyebolts 302, 304 suitably spaced from the frame of the cleat through which the line passes. For reasons that will become evident, the lower eyebolt 304 is the more important since that is the position over which the user has control and where the user pulls on the line. The remote end of the line, that is typically attached to a sail, has less impact on the cam since the line exits the cleat in proximity of the pin or rivet 174, which generally fixes the pusher against lateral movements. However, such deflection at the remote side is provided out of an abundance of caution, although it may be optional in most applications. An eyebolt is suggested because it secures the line in all directions. However, it will be evident that any suitable defection member may be used. It should also be appreciated that the eyebolt 304, for example, should be spaced a suitable distance from the proximate side of the cleat frame or housing. If the eyebolt is too close it may interfere with the movement of the line towards the cam even when the line is released and the tension is removed. For example, for a line ⅜" in diameter, the stiffness of such line could require that the eyelet be spaced from the cleat a distance of at least six inches and preferably one foot. For smaller diameter lines the distance can be decreased, while larger diameter lines may require somewhat greater spacing, in each case making sure that the deflection members do not hinder the line from being pushed by the pusher against the cam when the line is released and the tension removed.

The operation of the cleat shown in FIGS. 45, 46 is the same as for the previously described cleat designs. However, by mounting the pusher and cam on separate pivots or pins that are only connected to a wall of the housing or frame the latter can be shortened without jeopardizing or compromising the ability of the cleat to be safely and reliably mounted on a support surface so that the cleat can be minimized in size while being stable even upon generation of significant line stopping or locking forces.

While the invention has been described with reference to illustrative embodiments, it is not intended that the novel device be limited thereby, but that modifications thereof are intended to be included within the broad spirit and scope of the disclosure and the following claims and the appended drawings.

The invention claimed is:

1. A failsafe cleat with automatic in-line line-locking, comprising a frame having proximate and a remote sides on substantially opposite sides of said frame and formed with a passageway, extending between said proximate and remote sides, for receiving a line and generally defining a cleat center line along which a line can move along a first line releasing direction from said proximate to said remote sides and a line pulling direction from said remote to said proximate sides; attaching means for attaching said frame to a support surface; cam means on said frame on one side of said passageway and having a line engaging portion, said cam means being movable between a line releasing position and a line locking position, the line engaging portion being spaced a predetermined distance from the support surface and including a first engaging portion normally spaced a distance Δ from the line to form a clearance gap in the line releasing position and a second engaging portion bridging said clearance gap a distance equal to at least Δ for arresting the line and preventing movement of the line in the line releasing direction; a pusher on said frame on an opposite side of said passageway in relation to said cam means for selectively applying a force on the line in the direction of said cam means for urging the line across said clearance gap said distance Δ into contact with said first engaging portion only when tension in said line on said proximate side is less relative to the tension in the line at said remote side, continued contact between the line and the line engaging portion causing said second engaging portion of said cam means to bridge said distance Δ while said cam means moves from said releasing to said locking positions until a tension is applied by the user to the line on the proximate side that at least equals the tension at said remote side; cam biasing means tending to urge said cam means to disengage from the line; pusher biasing means normally tending to move the line across said gap into contact with said cam while permitting the line to return to said passageway out of contact with said cam means when sufficient tension is applied by the user off said cleat center line to create a force component to offset the pushing force created by said pusher biasing means thereby promote unlocking of the line and allow the line to move in said first line releasing direction, engagement of the line by said cam means to said line locking position creating a force couple which is a function of said predetermined distance tending to separate said frame from the support surface; and stabilizing means for compensating for and offsetting said force couple substantially independently of the dimensions or configuration of said frame.

2. A cleat as defined in claim 1, wherein said cam means and said pusher are pivotally mounted on hollow pins that define openings therein said frame having holes aligned with said openings, said attaching means comprising fastener means extending through at least one set of associated openings and frame holes to secure said frame to the support surface.

3. A cleat as defined in claim 1, wherein said cam biasing means comprises a spring acting between said frame and said cam means.

4. A cleat as defined in claim 1, wherein said cam biasing means comprises magnetic means that creates attracting magnetic forces acting on said cam means.

5. A cleat as defined in claim 4, wherein said magnetic means comprises a magnet mounted on said frame in proximity of said cam means, said cam means being formed of a magnetizable material to be attracted to said magnet.

6. A cleat as defined in claim 4, wherein said cam means is made of a non-magnetizable material, said magnetic means comprising a magnet mounted on said frame in proximity of said cam means, and a magnetizable portion mounted on said cam means that responds to said magnet.

7. A cleat as defined in claim 1, wherein said pusher biasing means comprises magnetic means that create repulsing magnetic forces acting on said pusher.

8. A cleat as defined in claim 7, wherein said magnetic means comprises a fixed magnet mounted on said frame having a predetermined polarity facing said pusher and further comprising a magnet mounted on said pusher that has a polarity facing said fixed magnet that is the same as said predetermined polarity to thereby repel said pusher in the direction of said cam means.

9. A cleat as defined in claim 1, further comprising deflection means for deflecting the line at at least said proximate side a predetermined angle in the direction of said pusher off said cleat center line.

10. A cleat as defined in claim 9, wherein said deflection is approximately within the range of 5 to 6 degrees maximum off said center line.

11. A cleat as defined in claim 9, wherein said deflection means comprises at least one deflection member spaced downstream from said proximate side for engaging and maintaining the line at a desired deflection angle off said center line, in the direction of said pusher, to prevent inadvertent engagement of the line from said cam when tension is applied to the line.

12. A cleat as defined in claim 1, wherein said stabilizing means comprises means for securing said frame to the support surface at a position between said line engaging portion of said cam means and said proximate side of said frame.

13. A cleat as defined in claim 1, wherein said stabilizing means comprises at least one fastener for attaching said frame to the support surface.

14. A cleat as defined in claim 13, wherein said at least one fastener comprises said attaching means.

15. A cleat as defined in claim 1, wherein said cam means and pusher are moveably attached to said frame between said remote side of said frame and line engaging portion of said cam means.

16. A cleat as defined in claim 1, wherein said frame comprises spaced main walls and at least two opposing side walls bridging said main walls and generally extending between said proximate and remote ends.

17. A cleat as defined in claim 1, wherein said pusher is provided with teeth or serrations on a portion thereof against which the line is forced by said cam means in said line locking position and having a smooth surface on a portion thereof that may contact the line prior to said line locking position of said cam means.

18. A cleat as defined in claim 1, further comprising cam means disabling means selectively interposed between the line and said cam means to prevent engagement between said cam means and the line when it is desired to freely move the line in the line releasing direction without being arrested by said cam means independently of the position of said pusher.

19. A cleat as defined in claim 18, wherein said cam means disabling means comprises an element manually movable between enabling and disabling positions in relation to said cam means.

20. A failsafe cleat with automatic in-line line-locking, comprising a frame having proximate and a remote sides on substantially opposite sides of said frame and formed with a passageway, extending between said proximate and remote sides, for receiving a line and generally defining a cleat center line along which a line can move along a first line releasing direction from said proximate to said remote sides and a line pulling direction from said remote to said proximate sides; attaching means for attaching said frame to a support surface; cam means on said frame on one side of said passageway and having a line engaging portion spaced a predetermined distance from the support surface, said cam means being movable between a line releasing position and a line locking position; a pusher on said frame on an opposite side of said passageway in relation to said cam means for selectively applying a force on the line in the direction of said cam means; cam biasing means tending to urge said cam means to disengage from the line; pusher biasing means normally tending to move the line across said gap into contact with said cam while permitting the line to return to said passageway out of contact with said cam means when sufficient tension is applied by the user off said cleat center line to create a force component to offset the pushing force created by said pusher biasing means thereby promote unlocking of the line and allow the line to move in said first line releasing direction, engagement of the line by said cam means to said line locking position creating a force couple which is a function of said predetermined distance that tends to separate said frame from the support surface; and stabilizing means for compensating for and offsetting said force couple independently of the dimensions or configuration of said frame.

* * * * *